US006385868B2

(12) United States Patent
Koene et al.

(10) Patent No.: US 6,385,868 B2
(45) Date of Patent: May 14, 2002

(54) JET EXCAVATING DEVICE

(75) Inventors: Rogier Cristian Koene, Delft; Rokus Van Den Bout, The Hague; Frits-Jan Koppert, Nieuwerkerkaan de Ijssel; Cornelius Van Zandwijk, Waddinxveen, all of (NL)

(73) Assignee: Heerema Holding Construction Inc., Geneva (CH)

( * ) Notice: Subject to any disclaimer, the term of this patent is extended or adjusted under 35 U.S.C. 154(b) by 0 days.

(21) Appl. No.: 09/796,608

(22) Filed: Mar. 2, 2001

Related U.S. Application Data

(63) Continuation of application No. PCT/NL00/00459, filed on Jun. 3, 2000.

(30) Foreign Application Priority Data

| | | |
|---|---|---|
| Jul. 2, 1999 | (NL) | 1012505 |
| Nov. 28, 1999 | (NL) | 1013687 |
| May 31, 2000 | (NL) | 1015365 |

(51) Int. Cl.[7] ..... E02F 5/02
(52) U.S. Cl. ..... 37/348; 37/905
(58) Field of Search ..... 37/347, 905, 348, 37/382, 308, 309, 344; 299/17, 1.3; 175/25, 67; 405/138

(56) References Cited

U.S. PATENT DOCUMENTS

| | | | | |
|---|---|---|---|---|
| 2,208,608 | A | | 7/1940 | Stanley |
| RE28,945 | E | * | 8/1976 | Miscovich et al. |
| 4,095,435 | A | | 6/1978 | Uemura |
| 4,401,345 | A | * | 8/1983 | Archibald |
| 4,534,427 | A | * | 8/1985 | Wang et al. |
| 4,610,321 | A | * | 9/1986 | Whaling |
| 4,708,395 | A | * | 11/1987 | Petry et al. |
| 4,739,841 | A | * | 4/1988 | Das |
| 4,854,770 | A | * | 8/1989 | Puchala et al. |
| 4,863,101 | A | * | 9/1989 | Pater et al. |
| 4,930,586 | A | * | 6/1990 | Turin et al. |
| 5,771,984 | A | * | 6/1998 | Potter et al. |
| 5,879,057 | A | | 3/1999 | Schwoebel et al. |
| 5,944,123 | A | * | 8/1999 | Johnson |
| 6,243,625 | B1 | * | 6/2001 | Wyatt et al. |
| 6,289,998 | B1 | * | 9/2001 | Krueger et al. |

FOREIGN PATENT DOCUMENTS

| | | | |
|---|---|---|---|
| DE | 4117575 | | 12/1991 |
| EP | 0507331 | | 10/1992 |
| EP | 0890708 | | 1/1999 |
| EP | 0893570 | | 1/1999 |
| FR | 2354444 | | 1/1978 |
| GB | 1446464 | | 8/1976 |
| JP | 62-55316 | * | 3/1987 |
| JP | 01310089 | | 12/1989 |
| JP | 4-60091 | * | 2/1992 |

* cited by examiner

*Primary Examiner*—Victor Batson
(74) *Attorney, Agent, or Firm*—Oblon, Spivak, McClelland, Maier & Neustadt, P.C.

(57) ABSTRACT

An excavating device configured to form a channel of predetermined cross section in the ground in an excavation direction. The excavating device includes an assembly of jet excavating units which together define the cross section of the channel and are each provided with at least one jet device. The excavating device also includes at least one sensor which is connected to at least one of the jet excavating units for measuring a force which is exerted on the jet excavating units by the ground substantially parallel to the excavation direction. A controller is provided for controlling the excavation by the excavating device on the basis of the force measured by the at least one sensor. The controller is adapted to set a flow rate of jet liquid which is used in at least one jet device.

46 Claims, 17 Drawing Sheets

JET EXCAVATING DEVICE

CROSS-REFERENCE TO RELATED APPLICATIONS

The present application is a continuation of PCT/NL00/00459, filed on Jun. 30, 2000 which was not published in English, which is incorporated in its entirety herein by reference.

BACKGROUND OF THE INVENTION

1. Field of the Invention

The present invention relates generally to an excavating device using a jet liquid to break up and mix with the ground such that the mixture can be discharged.

2. Discussion of the Background

EP-A-0 890 708 describes an excavating device which has a plurality of jet excavating units adjoining one another. In the jet excavating unit a rotating jet device is provided which sprays high-pressure jet liquid onto the ground which is to be excavated, which as a result is broken down. While the jet excavating device is being pulled through the ground in the excavation direction, the channel behind the jet excavating unit, which is formed by the jet device, is filled with a hardenable material. In this way, a wall is formed in the ground. Any desired shape can be selected for the channel to be formed in the ground, by arranging a number of jet excavating units in a desired way with respect to one another.

The known excavating device provides considerable drawbacks in relation to the way in which the excavation is controlled. Because of the increase in earth pressure as the depth in the ground increases, the known excavating device, given a relatively homogeneous soil composition, tends to tilt forwards, since in an excavating device of this nature which extends over a depth, the lower part will be subject to a greater resistance from the soil to be excavated than the part being above it. Consequently, the displacement of the lower part tends to lag behind the displacement of the upper part.

The rotating jet device has the drawback of including a plurality of moving parts, for example a motor and bearings, which are susceptible to faults and wear. Moreover, while the wall is being formed, the jet excavating device is not accessible for maintenance or repair purposes. Consequently, the excavating device is unreliable. Another complication is that under natural conditions the soil composition almost always varies in the excavation direction and/or over the cross section of the channel to be excavated, in particular when excavating under a slope, where it is highly probable that it will be necessary to cut through various soil strata. The jet devices of one or various jet excavating units are then simultaneously cutting through different types of soil, for example clay and sand, which exhibit different cohesion properties and thus break down under different jetting conditions. The variations in the nature of the soil cannot be predicted accurately, not even if an extensive and detailed soil analysis is carried out. The resistance to which the plurality of mutually adjacent jet excavating units are exposed by different types of soil during excavation varies, for example as a result of a first jet excavating unit excavating the soil to be excavated in front of it more quickly and more easily than a second jet excavating unit of the same excavating device. Consequently, the first jet excavating unit may excavate too much soil, with the result that the stability of the excavation front is jeopardized. Moreover, settlement occurs, leading to subsidence at ground level.

Another drawback of the known excavating device with a plurality of mutually adjacent jet excavating units is that obstacles which are encountered during excavation (for example unexploded bombs or rocky objects which cannot be cut up) are difficult to remove. It is usually impossible to move the obstacle out of the path of the channel which is to be excavated, and consequently the excavation process has to be interrupted and the obstacle has to be dug out of the path of the channel to be excavated from ground level, since the excavation front in front of the excavating device is not accessible in any other way. This is time-consuming and expensive and also causes problems for the environment above ground level. In the particular case in which the obstacle is displaced out of the path of the channel to be excavated, this may entail high local forces which cause damage to the excavating device.

SUMMARY OF THE INVENTION

The present invention provides an excavating device which to a large extent eliminates the drawbacks outlined above.

Accordingly, the present invention advantageously provides an excavating device for forming a channel of predetermined cross section in the ground, in an excavation direction, comprising an assembly of jet excavating units, which together define the cross section of the channel and are each provided with at least one jet device which can be operated with jet liquid. The jet liquid, such as water, which flows out of the jet devices is directed at the relatively soft ground which is to be excavated and includes, for example, of clay, sand or peat or a combination thereof. As a result, the ground is broken up and mixed with the jet liquid, after which the mixture obtained can be discharged. The excavating device has at least one sensor which is connected to at least one of the jet excavating units, for measuring a force which is exerted on the at least one jet excavating unit by the ground substantially parallel to the excavation direction, and control means for controlling the excavation by the excavating device on the basis of the force measured by the at least one sensor.

The excavating device according to the invention has the advantage that the force from the jet excavating unit is transmitted to the particles of soil in part via water pressure and in part mechanically, rendering the use of an excavating liquid superfluous. This saves on costs for the liquid and facilities required therefor and also provides excavated soil which can be reused more easily.

Another advantage of the invention is that the excavation process carried out by a system of jet excavating units can be successfully managed and better control of the excavating device can be obtained. The excavation carried out by the individual jet excavating units can be activated separately on the basis of forces measured locally in the cross section of the channel, with the result that the excavating device can move along a desired path accurately and under control, for example in order to ensure that the assembly of jet excavating units run simultaneously.

It is also possible, in the event of variations in the nature of the soil which are already known, for example from soil analysis, for the level of force to be locally adjusted according to a specific nature of the soil.

Moreover, with the excavating device according to the invention there is no need to carry out the measurements of the flow rate and the concentration of the soil mixture to be discharged by each excavating unit, since a force measurement is carried out instead of having to keep up to date with the soil balance. The fact that it is no longer necessary to measure the concentration of the soil mixture in particular yields considerable economic and safety benefits.

Since the excavation by the jet devices of the excavating device according to the invention is adapted on a local basis, i.e. for each jet excavating unit or for each jet device, to the desired or possible advancement, the use of energy and jet liquid is minimized, resulting in economic and environmental advantages.

In a preferred embodiment of the excavating device according to the invention, the control means are adapted to set a flow rate of the jet liquid used in at least one of the jet devices. In this way, it is easy to set the excavation by the jet device. Preferably, the flow rate of the at least one jet device of the jet excavating unit connected to the at least one sensor is set. This makes the control means simple to implement, since there is no need to take into account the possibility of different jet excavating units influencing one another. Preferably, the control means are adapted to increase or reduce the flow rate of the jet liquid of the at least one jet device in the event of an increase or decrease, respectively, in the force measured by the at least one sensor. This has the advantage that the resistance which the excavating device is subject to from the soil during excavation can be kept within a permitted range. Preferably, the setting of the flow rate of the jet liquid of the at least one jet device can be varied, for example can be varied continuously or in steps, between a predetermined minimum level and a predetermined maximum level. As a result, it is possible for the resistance which the excavating device is subject to during excavation to be continuously adapted, so that the original horizontal stresses in the soil are affected as little as possible, and settlement leading to subsidence at ground level is prevented. To set the desired horizontal soil stresses, the control means are preferably adapted to vary, for example continuously or in steps, the flow rate of the jet liquid of the at least one jet device of at least one jet excavating unit between a predetermined minimum and a predetermined maximum level on the basis of the force measured by the at least one sensor connected to the at least one jet excavating unit.

In a preferred embodiment of the excavating device according to the invention, the control means are adapted to supply jet liquid to the at least one jet device of at least one of the jet excavating units where the force exceeds a defined level, and to restrict the supply of jet liquid to a minimum value when the force drops below said level. The control means determine the forces at the excavation front which occur at the location of the respective jet excavating units and use the relevant data to select the jet excavating unit or units where the force exceeds a defined level or the jet excavating unit where the force is highest. Then, only the one or more selected jet excavating units are provided with jet liquid as required, within defined limits, and the other jet excavating units are provided with only little or no jet liquid. At the one or more selected jet excavating units, a method of this nature will lead to the force falling to below a predetermined level over the course of time. The supply of jet liquid to the one or more selected jet excavating units is then minimized or interrupted altogether. Then, the control means once again select the jet excavating unit or units where the force exceeds a defined level at that moment or the jet excavating unit where the force is highest at that moment, and only the selected one or more jet excavating units are supplied with jet liquid, and so on.

In this way, the jet liquid is guided substantially to the one or more jet excavating units where it is most required, and no more jet liquid is supplied for any longer than is necessary on the basis of the measured force. In this way, the energy required for jet excavation is reduced to a minimum and is adapted to the prevailing soil conditions. If the total amount of jet liquid required for the excavating device exceeds the maximum capacity of the jet liquid supply system, the control means ensure that the velocity of the excavating device in the excavation direction is reduced, with the result that the amount of jet liquid required is reduced. If the total amount of jet liquid required is less than the maximum capacity of the jet liquid supply system, the velocity of the excavating device can be increased until the amount of jet liquid required is substantially equal to the maximum capacity of the jet liquid supply system.

In a preferred embodiment, the jet devices are each fed, via a line in which a controllable valve is incorporated, from a jet pump which supplies a constant flow rate of jet liquid, the fraction of the jet liquid flow which is not taken up by the jet devices being supplied, via at least one system line in which a controllable valve is incorporated, to a space of the jet excavating units. In this way, the total flow of jet liquid which is supplied to the excavating device is not influenced by the amount of jet liquid being used by the one or more jet excavating units at any given moment. The flow of jet liquid/soil mixture to be discharged is also constant. If the nature of the soil is such that the maximum capacity of the jet liquid supply system is required for one or more jet excavating units, the entire flow of jet liquid generated by the jet pump passes to the one or more jet excavating units, and there is no jet liquid flowing through the system line. In the other extreme case, in which none of the jet excavating units need any jet liquid, all the flow generated by the jet pump passes via the system line to a space of the jet excavating units.

Preferably, the control means are adapted to set the controllable valve in the at least one system line in such a manner that a delivery pressure set for the jet pump is marginally higher than the maximum pressure required for the jet devices. Due to the system pressure which can be varied in this way, the delivery pressure of the jet pump is not (much) higher than is strictly necessary, leading to a minimum pressure drop (and therefore a low energy consumption) across the controllable valves in the lines leading to the jet excavating units.

In a further preferred embodiment, the excavating device comprises a drive device for displacing the excavating device substantially in the excavation direction, which drive device is preferably controlled by the control means. This results in the advantage that the propulsive force and the speed at which excavation is carried out can be adapted to the total resistance which the excavating device is subject to during excavation of the soil to be excavated.

Preferably, the control means are adapted to measure the current amount of jet liquid required for the assembly of jet excavating units and to adapt the velocity of the drive device to the available flow of jet liquid for the assembly of jet excavating units.

In a further preferred embodiment the excavating device comprises a support structure which supports the jet excavating units, thus making the measurement of the force acting on the jet excavating units easy to carry out. Preferably, part of the support structure can be removed for the purpose of removing at least one of the jet excavating units. This is advantageous in particular in the event, for example, of maintenance to the excavating device or if the excavating device becomes jammed at an obstacle situated in front of one or more of the jet excavating units. Unlike in the known excavating device, the obstacle does not have to be displaced out of the path of the channel to be excavated or removed from ground level. The excavating device according to the invention simply has to be shut down and dismantled locally. The relatively small opening in the rear side of the excavating device which is caused by the local dismantling is small, so that the stability of the excavation front can be largely ensured. This leads to rapid, safe and effective removal of obstacles.

In another preferred embodiment, the support structure is provided with compartments which substantially completely surround the jet excavating units. This leads to a simple structure of the jet excavating units, and the support structure can assume certain functions of the jet excavating units.

In another preferred embodiment, one or more of the jet excavating units can be displaced with respect to the support structure, substantially parallel to the excavation direction, with the aid of a displacement device, in particular comprising a jack. It is thus possible for jet excavating units to be moved forwards in the excavation direction one by one or group by group with respect to the support structure and the other jet excavating units. In this case, in the first instance, the resistance presented by the soil to a single jet excavating unit or a group of jet excavating units is overcome as the jet excavating unit or units is/are moved forwards with their jet device(s) in operation, and then the resistance presented by the soil to another jet excavating unit, another group of jet excavating units and/or the support structure is overcome as it moves forwards. With a method of this type, a reduced propulsion capacity of the (drive device of the) excavating device and a reduced flow rate for the jet devices will be sufficient, since in this case the jet excavating units are not all moved forwards simultaneously in the excavation direction, and the jet devices are not all in operation simultaneously.

If the jet excavating units can be moved separately from one another, substantially parallel to the excavation direction, over a defined distance with respect to the support structure, obstacles in the ground can be at least partially dug out by allowing the jet excavating units situated outside the area of an obstacle to adopt an advanced position with respect to the support structure and allowing the jet excavating units which are situated inside the area of the obstacle to adopt a position which is as far back as possible with respect to the support structure, until further advance of the excavating device is impeded by the obstacle. Then, the obstacle, which has already been at least partially excavated around, is removed in the manner indicated above.

In a preferred embodiment, the at least one jet device of at least one jet excavating unit is adapted to expel a jet of jet liquid in a fixed direction. This measure means that the jet device does not comprise any moving parts and requires little maintenance, and little wear occurs.

In a further preferred embodiment, the jet of jet liquid which is expelled in a fixed direction from a jet device is oriented at an angle to the excavation direction, enabling the soil to be broken up and discharged effectively. In particular, the jet liquid jet expelled in a fixed direction from a jet device is inclined backwards as seen in the excavation direction and in the direction as the force of gravity (for a substantially horizontal excavation direction). This ensures that the soil is broken up and discharged effectively.

In another preferred embodiment, at least one of the jet excavation units comprises a number of jet devices, the jet liquid jets from which are oriented in different, fixed directions. This makes it possible to excavate the soil over the entire cross section of the jet excavating unit.

In this embodiment, it is possible in particular for the jet devices of a jet excavating unit to be operated intermittently, and more particularly alternately, each jet device covering, for example, an area of the cross section of the jet excavating unit. Similarly, the jet devices of different jet excavating units can be operated intermittently, and more particularly alternately. Tests have shown that jet excavation carried out intermittently does not reduce the effectiveness of the jet device compared to a jet device which expels a continuous flow of jet liquid. However, a substantial advantage of intermittent operation of jet devices is that the flow rate of jet liquid required, which can be supplied in a continuous flow and can be guided to different jet devices via controllable valves, is reduced considerably.

In another preferred embodiment, at least one of the jet devices is arranged on a side wall of the at least one jet excavating unit, the jet liquid jet expelled in a fixed direction from the at least one jet device being oriented substantially transversely to the excavation direction.

In a further preferred embodiment, the at least one jet device of an excavating unit comprises at least one tube which extends substantially in the excavation direction and is provided on its circumference with at least one outlet opening. In particular, the tube is arranged centrally in the jet excavating unit and the tube comprises a number of outlet openings which are positioned at a distance from one another as seen in the longitudinal direction of the tube and at different angles as seen in the circumferential direction of the tube. The jet device may comprise various tubes of this nature arranged centrally in the jet excavating unit or, to achieve the same results, may comprise a single tube which is internally divided into separate ducts by means of elongate partitions, with at least one outlet opening adjoining each of the separate ducts. If the outlet openings expel jet liquid jets which are such that each jet liquid jet covers part of the cross section, as seen from the front side of the jet excavating unit, and all the jet liquid jets together cover the entire cross section, the complete cross section of the soil entering the jet excavating unit is broken up. The shape of the three-dimensional cutting surface may be varied in such a manner that the cutting process is made as efficient as possible. The capacity of the outlet opening is selected according to the size of the cross-sectional part which is to be excavated by the outlet opening in question. By successively feeding a jet liquid jet to different tubes or ducts by means of controllable valves, an intermittent flow of jet liquid is produced at the at least one outlet opening connected to a tube or duct, and different parts of the cross section are successively covered by the jet excavating unit. By varying the order in which medium flows out of the various tubes or ducts, it is possible to adapt the efficiency of the excavation process.

Preferably, at least one jet excavating unit is provided with means in which the at least one jet device is releasably secured. This has the advantage that the jet device can easily be placed into and removed from the jet excavating unit, for example for maintenance purposes. For this purpose, the jet device preferably comprises a passage in a back wall of the jet excavating unit for introducing the jet device into the jet excavating unit, a closure means being provided for the purpose of bridging the pressure difference between the area in front of and behind the jet excavating unit when removing the jet device. It is then no longer necessary to even out the pressure in front of and behind the jet excavating unit before the jet device can be removed.

In the known excavating devices with bucket-wheel excavating devices, a probe which determines the nature of the soil in front of the excavating device cannot be used during the excavating process, but rather only when the excavating device is at a standstill. According to the prior art, the probe has to be removed before the excavating device is switched on. Therefore, continuous anticipation of the nature of the ground is not possible. Moreover, it is impossible to provide a continuous warning of obstacles. There is increased risk that obstacles will only be signalled after the excavating device has become stuck, which increases the levels of wear and may cause damage, in particular if the obstacle is an unexploded explosive object. By contrast, in a preferred embodiment the excavating device according to the invention has at least one probe which is adapted to determine the nature of the soil at a distance in front of the jet excavating units, as seen in the excavation direction, during excavation. This is a considerable advantage, since it enables the nature of the soil to be continuously anticipated. Another advantage is that the probe can be arranged at various locations in the cross section of the excavator shield and it is not restricted to a single location in the excavator shield, so that it is also possible to locally anticipate variations in the soil composition.

In a preferred embodiment, the excavating device comprises at least two probes for determining the nature of the soil between and around the at least two probes.

Preferably, there is at least one removable sealing means for sealing the space between adjacent jet excavating units or between a jet excavating unit and the support structure. As a result, it is possible for the jet excavating units to move independently of one another and to bridge the pressure difference which prevails between the area in front of and behind the jet excavating unit, where atmospheric pressure prevails.

Preferably, the at least one sensor connected to the at least one jet excavating unit is positioned between the support structure and the at least one jet excavating unit. This arrangement makes it easy to measure the forces acting on the jet excavating units, since the sensors can be fitted on the support structure.

The at least one sensor expediently comprises a piston-cylinder unit which can be operated by a fluid, which sensor is provided with pressure measuring means for recording a pressure of the fluid. The measured pressure is a measure of at least part of the force exerted on the sensor connected to the jet excavating unit or units. The piston-cylinder unit can also function as a displacement unit for displacing one or more jet excavating units of the excavating device substantially parallel to the excavating device with respect to the support structure.

In a preferred embodiment, the at least one jet excavating unit comprises at least one plate which is arranged substantially transversely to the excavation direction, the at least one sensor connected to the at least one jet excavating unit being adapted to measure substantially the force acting on the plate in the excavation direction. This has the advantage that the pressure being exerted by the soil is measured very directly.

In a preferred embodiment, the at least one sensor is connected, via the jet device, to the at least one plate, resulting in a functional unit which can be used in a jet excavating unit for jet excavation of the soil and measuring the force in the excavation direction at the location of the jet excavating unit.

In a preferred embodiment of the excavating device according to the invention, an excavation chamber is formed in a jet excavating unit by a space in which the at least one jet device is arranged, the excavation chamber being adjoined, on the rear side, as seen counter to the excavation direction, by, in succession, a front plate, which extends from the top side of the excavation chamber to a distance from the underside of the excavation chamber, and a back plate, which extends at a distance from the front plate, from the underside of the excavation chamber to a distance from the top side of the excavation chamber. The front plate and the back plate support the soil to be removed and allow controlled removal of the mixture of jet liquid and soil which is formed in the jet excavating unit. Furthermore, for this purpose a mixing chamber is formed behind the back plate, by a space with an outlet opening for discharging a mixture of soil and jet liquid. Preferably, a supply of mixing liquid, which may be the same as the jet liquid, is supplied to the mixing chamber via a feed, and the outlet opening is situated in the vicinity of an underside of the mixing chamber. The system line from the jet pump described above may lead to the mixing chambers of the jet excavating units.

The separation of the jet excavating unit into an excavation chamber and a mixing chamber makes it possible to set the flow rate of the jet liquid and the flow rate of the mixing liquid independently of one another. The flow rate of the jet liquid is determined by the resistance encountered from the soil and may vary considerably according to the soil conditions which occur. The flow rate of the mixing liquid for discharging the mixture of soil and jet liquid from the mixing chamber is determined by the minimum flow velocity which is required in order to entrain the soil particles multiplied by the cross section of the discharge line.

The front plate and the back plate separate the excavation chamber and the mixing chamber from one another. The front plate and the back plate preferably run substantially vertically (in the direction of the force of gravity). The (ratio of the) dimensions of the jet excavating unit are selected in such a manner that the incoming soil is initially forced to flow horizontally. Then, the soil is forced to flow upward, counter to the force of gravity, between the front plate and the back plate. The weight of the column of soil between the front plate and the back plate is sufficient to stabilize the excavation front by preventing soil from spontaneously flowing into the excavation chamber. The soil particles have to be actively stimulated to flow over the top edge of the back plate. The jet(s) in the excavation chamber cause a flow of water through the pores of the soil, in the direction of the opening between the front plate and the back plate. This flow of water ensures that a flow pressure is exerted on the soil particles, so that they start to float and friction between them is eliminated (fluidization), with the result that the mixture of soil and water which has been jet-excavated flows over the back plate. If the jets in the excavation chamber are shut down, the flow of soil from the excavation chamber to the mixing chamber stops immediately, with the result that the mixing chamber remains permanently open.

In a preferred embodiment, the mixing chamber comprises a space which is common to a number of jet excavating units, resulting in a simple and inexpensive structure.

To minimize the problems caused by obstacles which enter the mixing chamber via the excavation chamber, a crusher is arranged in the mixing chamber upstream of the outlet opening, which is able to crush the obstacles.

In a preferred embodiment, a non-return valve is arranged between the excavation chamber and the mixing chamber, in order to allow the mixture of soil and jet liquid to pass from the excavation chamber to the mixing chamber but blocking it from passing in the opposite direction. A mixture of soil and jet liquid is thus prevented from flowing back out of the mixing chamber into the excavation chamber if the pressure in the excavation chamber is too low.

Preferably, the front plate or the back plate is connected to a grate which extends from the underside or the top side of the excavation chamber to the front plate or back plate, respectively, in such a manner that material which is retained by the grate returns under the force of gravity to an area of the jet excavating unit which is reached directly by the liquid jet from the at least one jet device. The front plate and the back plate provide a desired flow of a mixture of soil and jet liquid which is situated in the jet excavating unit, while the grate prevents the discharge of the mixture becoming stagnant as a result of coarse material being retained.

The claims and advantages will be more readily appreciated as the same becomes better understood by reference to the following detailed description and considered in connection with the accompanying drawings in which like reference symbols designate like parts or parts having the same or similar function.

DESCRIPTION OF THE PREFERRED EMBODIMENTS

Figure 1A:
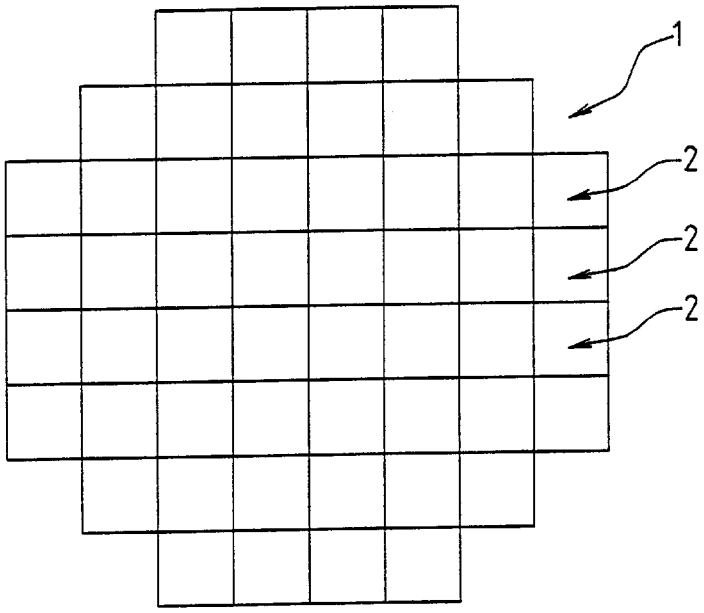
FIG. 1*a* diagrammatically depicts a front view of an assembly of adjacent jet excavating units for forming a channel which is substantially circular in cross section.
Figure 1B:
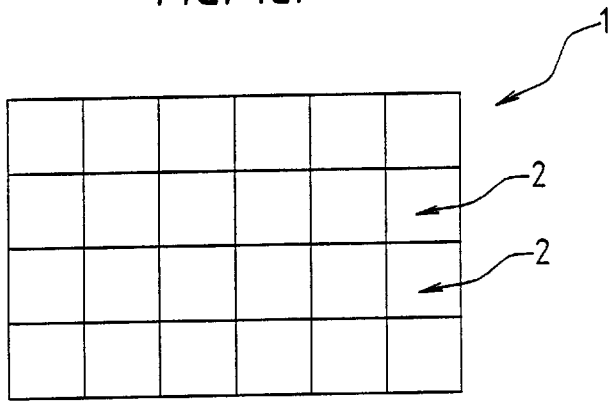
FIG. 1*b* diagrammatically depicts a front view of an assembly of adjacent jet excavating units for forming a channel which is substantially rectangular in cross section.
Figure 1C:
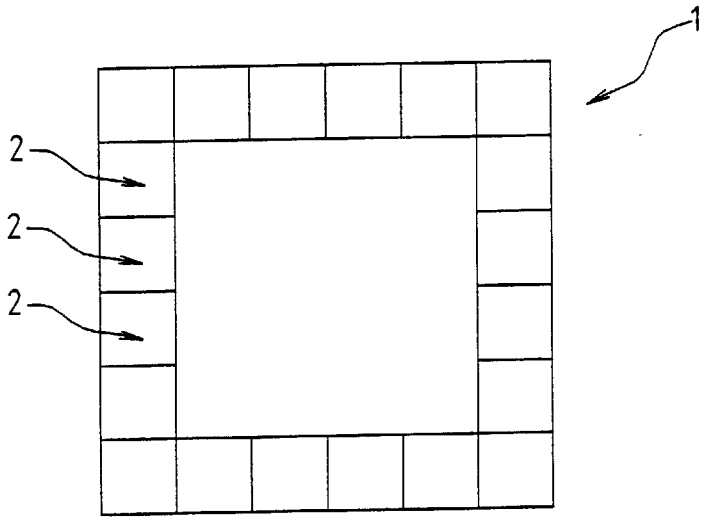
FIG. 1*c* diagrammatically depicts a front view of an assembly of adjacent jet excavating units for forming another channel which is rectangular in cross section.

FIGS. 1*a*, 1*b* and 1*c* illustrate various excavating devices 1 which comprise a plurality of jet excavating units 2 which are arranged adjacent to one another, so that a desired cross section of a channel to be excavated in the soil is defined. The excavating device 1 shown in FIG. 1*a* is used to form a substantially circular cross section of the channel in the ground, and the excavating device 1 shown in FIG. 1*b* is used to form a substantially rectangular cross section of the channel. In the excavating device 1 shown in FIG. 1*c*, the jet excavating units 2 are in each case connected to two other jet excavating units 2, so that a rectangular cross section is enclosed. Naturally, any other desired arrangements of jet excavating units are also possible, with corresponding cross sections of the channel to be excavated in the ground.

Figure 2A:
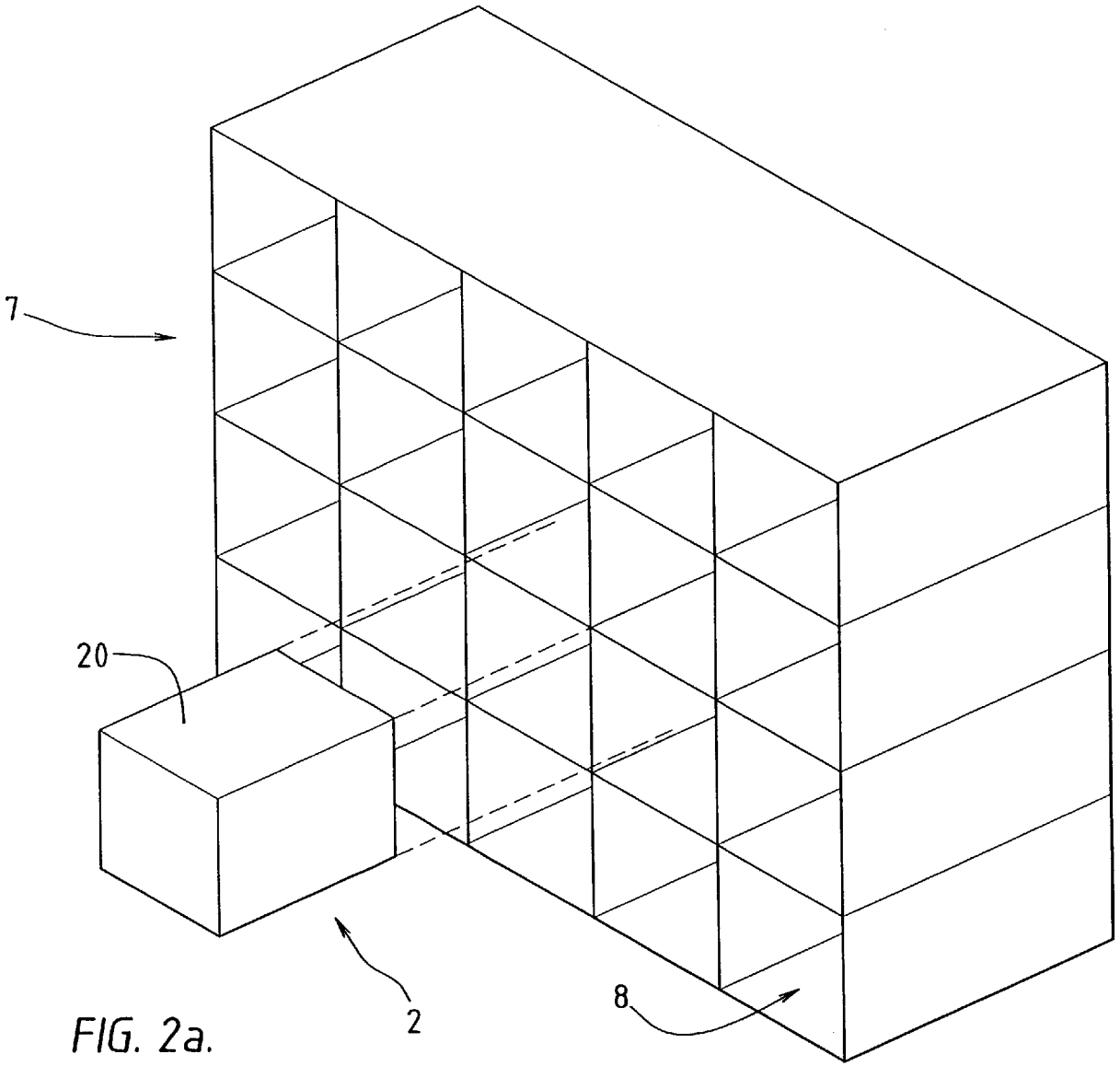
FIG. 2*a* shows a diagrammatic, perspective view of a first embodiment of an excavating device according to the invention.
Figure 2B:
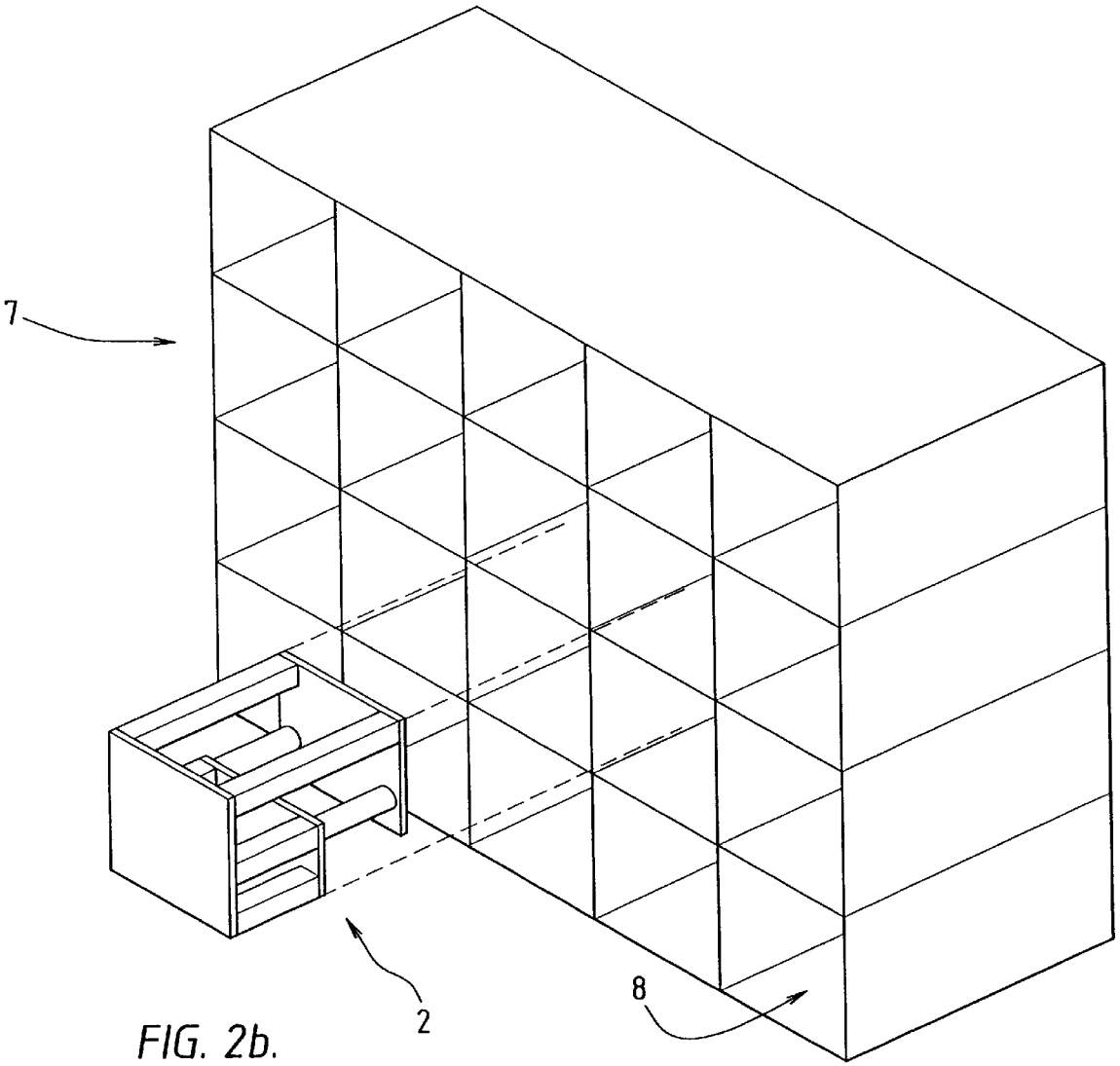
FIG. 2*b* shows a diagrammatic, perspective view of a second embodiment of an excavating device according to the invention.

In FIG. 2*a*, the jet excavating units 2 comprise walls 20, and the jet excavating units 2 are pushed into compartments 8 of a support structure 7. In FIG. 2*b*, the jet excavating units 2 are configured without walls.

Figure 3:
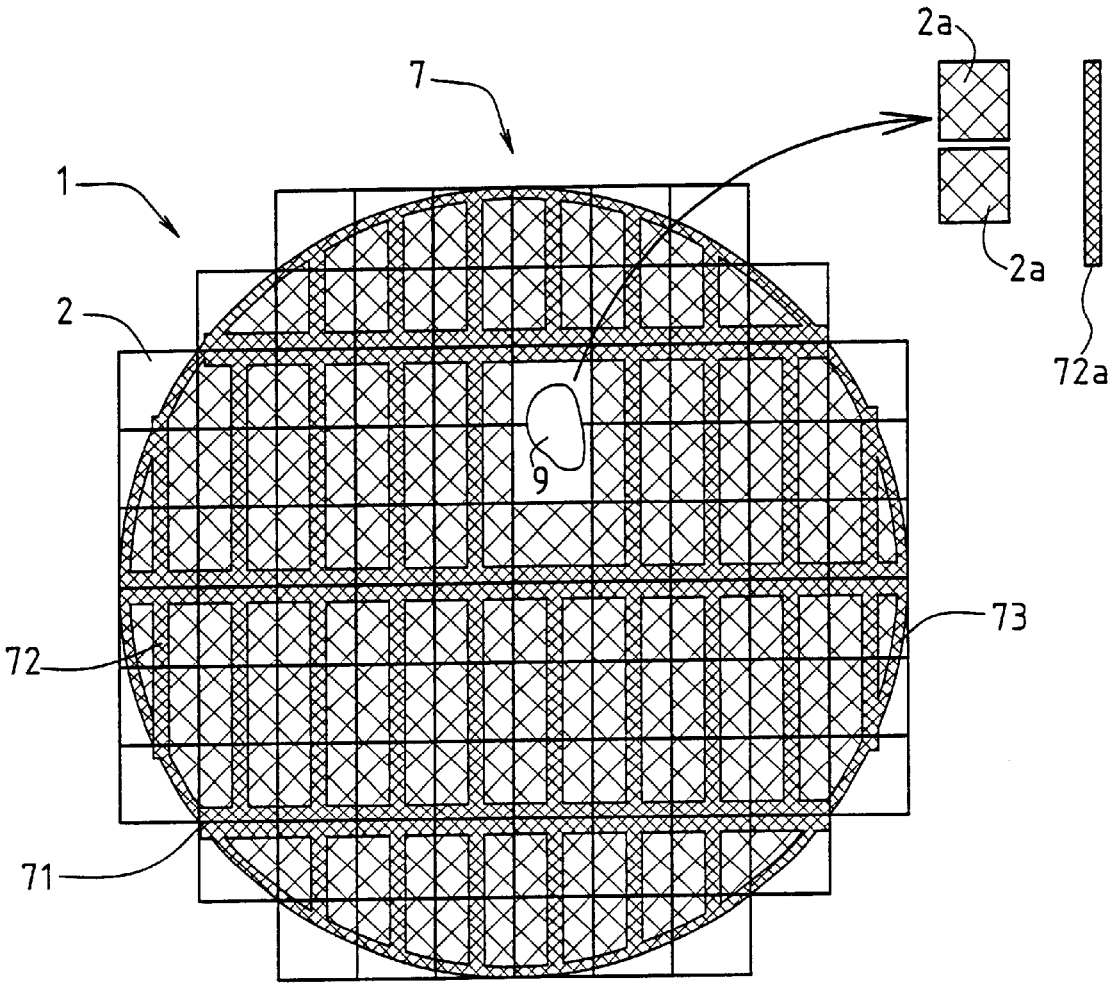
FIG. 3 shows a diagrammatic rear view of a third embodiment of an excavating device according to the invention.

FIG. 3 shows a rear view of an excavating device 1 according to the invention, in which a support structure 7 comprises three fixed principal bars 71, removable auxiliary bars 72 which are oriented transversely to the principal bars 71, and a support ring 73. The excavating device illustrated in FIG. 3 has been stopped by an obstacle 9, for example a rock-like material, so that the progress of the excavating device 1 in the ground has been blocked. To remove the obstacle 9, an auxiliary bar 72*a* has been removed, after which two jet excavating units 2*a* are removed from the assembly of jet excavating units 2, so that the obstacle is accessible and can be removed easily.

Figure 4A:
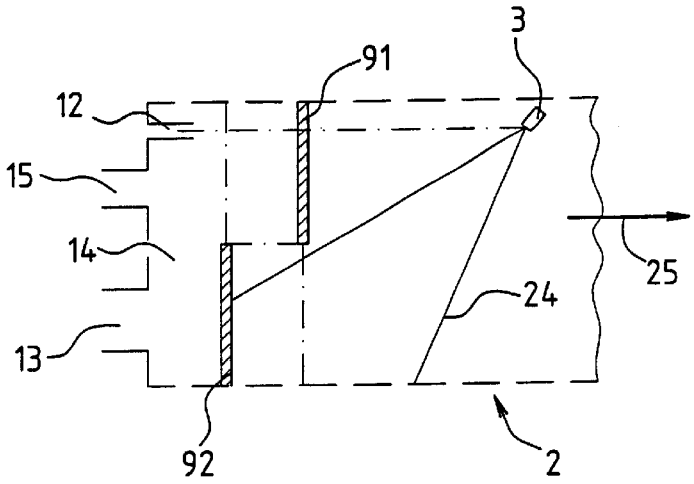
FIGS. 4*a* and 4*b* show a side view, partially in longitudinal section, and a front view, respectively, of a first arrangement of jet devices in a jet excavating unit.
Figure 4B:
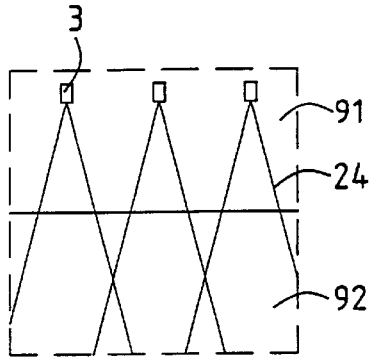

FIGS. 4*a* and 4*b* show a first arrangement of jet devices 3 in a jet excavating unit 2. As explained above with reference to FIGS. 2*a* and 2*b*, the jet excavating unit 2 may be configured both with and without walls, therefore, in subsequent figures the boundary of the jet excavating unit 2 is indicated by dashed lines. In a manner which is not illustrated in more detail, for example via a hose or pipe indicated by a dot-dashed line, the jet devices 3 are fed with a jet liquid, such as water, from an inlet opening 12 of the jet excavating unit 2, so that jets 24 are formed. The jet devices 3 break up the soil to be excavated by spraying the jet liquid on to the soil at high pressure. The considerable turbulence which is generated while the soil is being broken up is to intimately mix the soil with the jet liquid, so that a mixture of soil and jet liquid is formed, which is easy to discharge. In addition, there is a front plate 91 and a back plate 92. These plates 91, 92 serve as mechanical support if the excavation front becomes unstable and collapses. These plates 91, 92 also block large pieces of soil and other material which may become detached while the soil is being broken up, so that these pieces can be broken up more fully. If appropriate, a grate denoted by a dot-dashed line may be arranged between the bottom edge of the front plate 91 and the underside of the jet excavating unit 2, or between the top edge of the back plate 92 and the top side of the jet excavating unit 2, or between the front plate 91 and the back plate 92, in order to retain relatively large pieces of soil material. In this way, the plates 91, 92 divide the jet excavating unit at least into an excavation chamber (the space in which the jet devices 3 are arranged) and a mixing chamber 14. The mixing chamber 14 is provided with a supply of mixing liquid 15 and a liquid/soil outlet 13. In the case of sand, the particles have to be pushed over the edge of the back plate 92, into the mixing chamber 14. If the jet devices 3 are too powerful, there will be an uncontrolled flow of sand into the mixing chamber 14 and the front will become unstable. In clay, the soil which enters the excavation chamber as a result of the advance of the excavating device 1 is broken up, the cohesion properties of clay, if appropriate in combination with a mixing chamber pressure, ensuring that the excavation front remains stable. After soil in the excavation chamber of the jet excavating unit 2 has been broken up by the jet liquid, the mixture of soil and jet liquid in the mixing chamber 14 is mixed with a mixing liquid, such as water, supplied via the mixing liquid feed 15 and is then discharged through the liquid-soil outlet 13. The jets 24 are directed in the same direction as the force of gravity and backwards, as seen in an excavation direction 25. With this arrangement of the jet devices 3, the breaking up of the soil caused by the jet devices 3 remains entirely inside the jet excavating unit 2. In addition, soil which passes to behind the range of the jets 24 will fall back into range of the jets 24 due to the presence of the front plate 91 and the back plate 92 and will then still be broken up. With this arrangement, it is virtually impossible for large pieces of soil which have not been broken up to enter the mixing chamber 14 and then block the liquid/soil outlet 13.

Figure 5A:
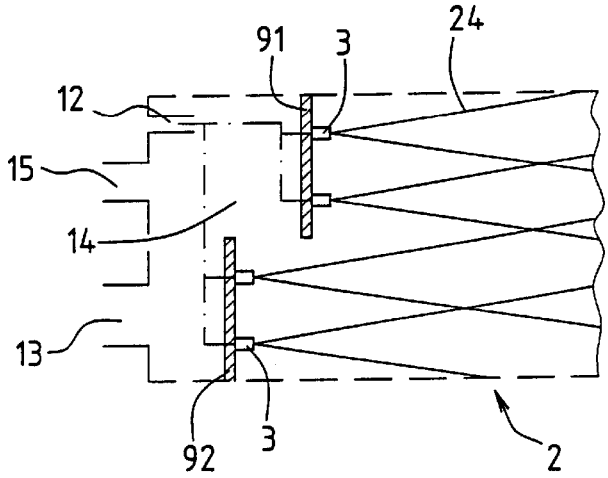
FIGS. 5*a* and 5*b* show a side view, partially in longitudinal section, and a front view, respectively, of a second arrangement of jet devices in a jet excavating unit.
Figure 5B:
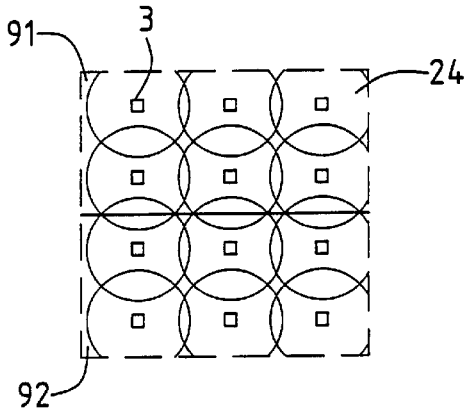

FIGS. 5*a* and 5*b* show a frontal arrangement of the jet devices 3, which are arranged on the front plate 91 and the back plate 92. Frontal jets 24 become more efficient as the soil penetrates further into the jet excavating unit 2, ensuring that the liquid/soil outlet 13 for the mixture of soil and jet liquid cannot become blocked and that the jet excavating unit 2 can always be blown empty. However, this arrangement of the jet devices 3 lacks a front boundary for the breaking up of the soil caused by the jet devices. In the case of sandy soil, for example, an excessively strong jet liquid jet 24 may weaken the soil in front of the excavating device, making the excavation front unstable.

Figure 6A:
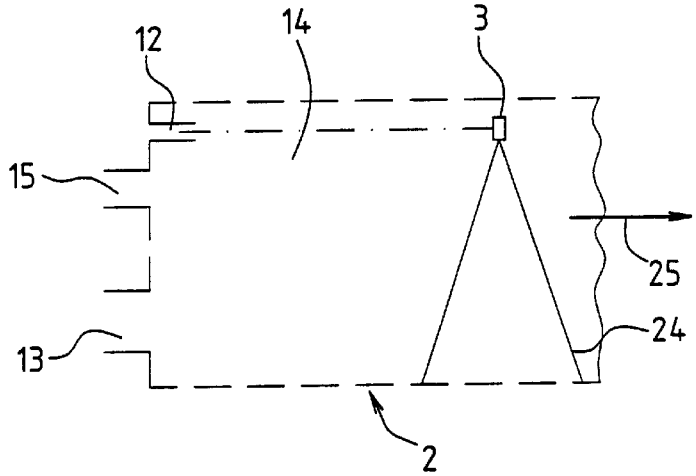
FIGS. 6*a* and 6*b* show a side view, partially in longitudinal section, and a front view, respectively, of a third arrangement of jet devices in a jet excavating unit.
Figure 6B:
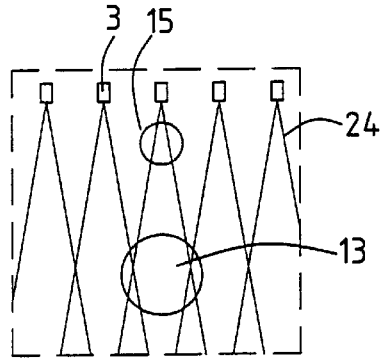

FIGS. 6*a* and 6*b* show a jet excavating unit 2 without plates and with jet devices 3 which spray jets 24 transversely with respect to the excavation direction 25 and in the same direction as the force of gravity. With this arrangement of the jet devices 3, the breaking up of the soil caused by the jet devices will take place entirely within the jet excavating unit 2, so that a stable front can be ensured. It should be noted that soil which reaches behind the range of the jet devices 3 can no longer be removed from the jet excavating unit, which may cause blockage of the liquid/soil outlet 13.

Figure 7A:
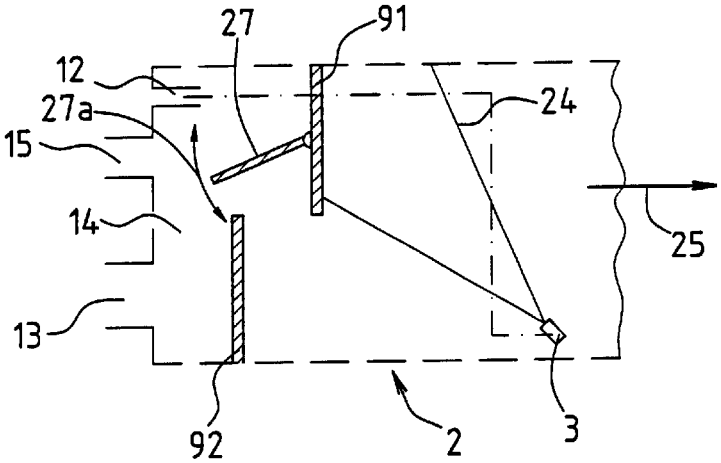
FIGS. 7*a* and 7*b* show a side view, partially in longitudinal section, and a front view, respectively, of a fourth arrangement of jet devices in a jet excavating unit.
Figure 7B:
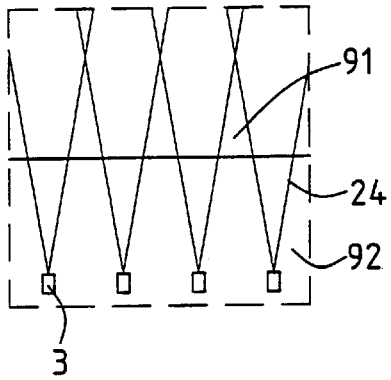

FIGS. 7*a* and 7*b* show an arrangement of the jet devices 3 which, as seen in the excavation direction 25, is directed obliquely backwards and counter to the force of gravity, which promotes the suspension of broken-up soil in the mixture of soil and jet liquid in the jet excavating unit 2. A non-return valve 27 which can pivot in the directions of double arrow 27*a* is hinged to the rear side of the front plate 91. The non-return valve 27 allows the mixture of soil and jet liquid to flow from the excavation chamber to the mixing chamber, but effectively prevents flow in the opposite direction.

Figure 8A:
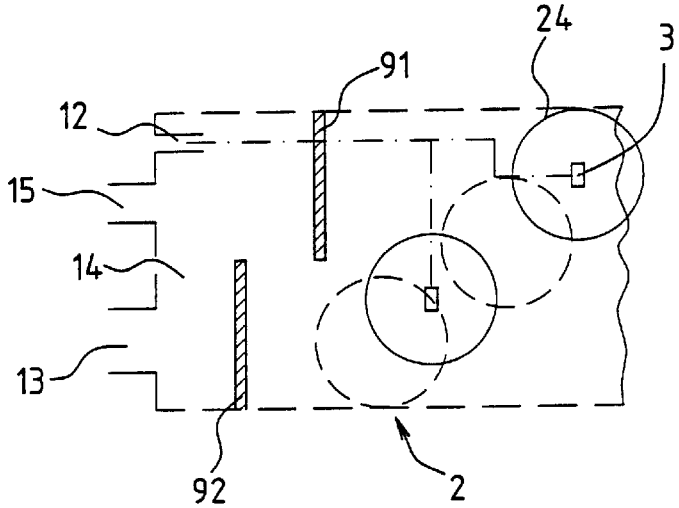
FIGS. 8*a* and 8*b* show a side view, partially in longitudinal section, and a front view, respectively, of a fifth arrangement of jet devices in a jet excavating unit.
Figure 8B:
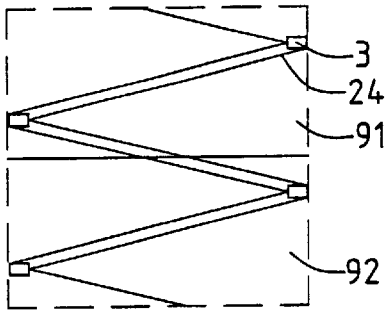

FIGS. 8*a* and 8*b* show jet devices 3 arranged on the side walls of the jet excavating units 2, with the result that the soil in front of the back plate 92 is broken up successfully.

Figure 9:
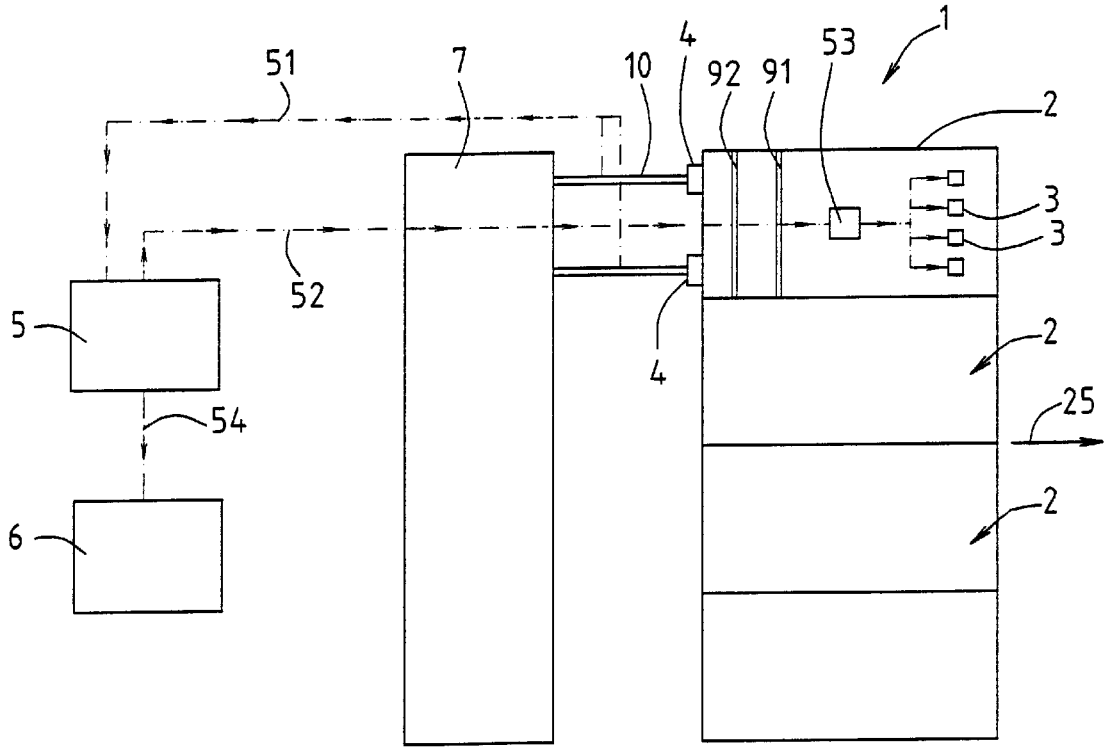
FIG. 9 diagrammatically depicts a partially cut-away top view of an excavating device according to the invention, supplemented with elements illustrated in the form of a block diagram.

FIG. 9 shows an excavating device 1 which comprises a number of substantially identical jet excavating units 2 as shown in FIGS. 4*a*, 4*b* or FIGS. 7*a*, 7*b*, which are connected, via connecting bars 10, to a support structure 7. Between the jet excavating units 2 and the support structure 7 there are sensors 4 which measure the forces which the jet excavating units 2 are subject to during the advancement of the excavating device 1 in the base of the soil to be excavated, in the direction of arrow 25. In this case, it is ensured, in a manner, for example by arranging the various jet excavating units moveably with respect to one another, that only the desired forces are measured. The sensors 4 are connected to a controller or control means 5 via control lines 51. From the control means 5, control lines 52 run to a regulating unit 53 arranged in the jet excavating unit 2, such as for example an adjustable valve which sets the flow rate of the jet liquid flowing out of the jet devices 3. In FIG. 9, the control arrangement is such that the flow rate of each of the jet devices 3 is set on the basis of the forces acting on the associated jet excavating unit 2, which are measured by the associated sensor 4. If one of the jet excavating units 2 is subject to resistance from the soil to be excavated which is above a predetermined level, which can be detected using the sensors 4, the flow rate of the jet devices 3 of the jet excavating unit 2 in question is increased. As a result, the excavation capacity of this jet excavating unit 2 will increase, with the result that more soil is excavated, after which the force which the soil to be excavated exerts on this jet excavating unit 2 decreases. The flow rate is then reduced by the regulating unit 53. In this way, the flow rate of the jet devices 3 of some or all of the jet excavating units 2 of the assembly of jet excavating units is adjusted continuously. This measurement and regulating process leads to excellent control of the excavation.

It is also possible for the forces of a first jet excavating unit 2, which have been measured by the sensors 4, to be used to control the flow rate of jet devices 3 of a second jet excavating unit 2. By way of example, if there are extensive assemblies of jet excavating units 2, one or more of the sensors 4 may also be connected to a plurality of jet excavating units 2 simultaneously, so that it is no longer the force on a single jet excavating unit 2, but rather the force on a plurality of jet excavating units 2, for example a horizontal row of such units, which is measured. This embodiment, which is not shown, is less finely tuned but reduces the number of sensors 4 required. A combination of the options described above is also possible. The control unit 53 may be arranged outside the interior of the jet excavating unit 2.

From the control means 5, a control line 54 also runs to a drive device 6 which is connected to the excavating device 1 for advancing the excavating device 1 in the excavation direction 25 on the basis of the forces acting on one or more of the jet excavating units 2, which have been measured by the sensors 4.

Figure 10:
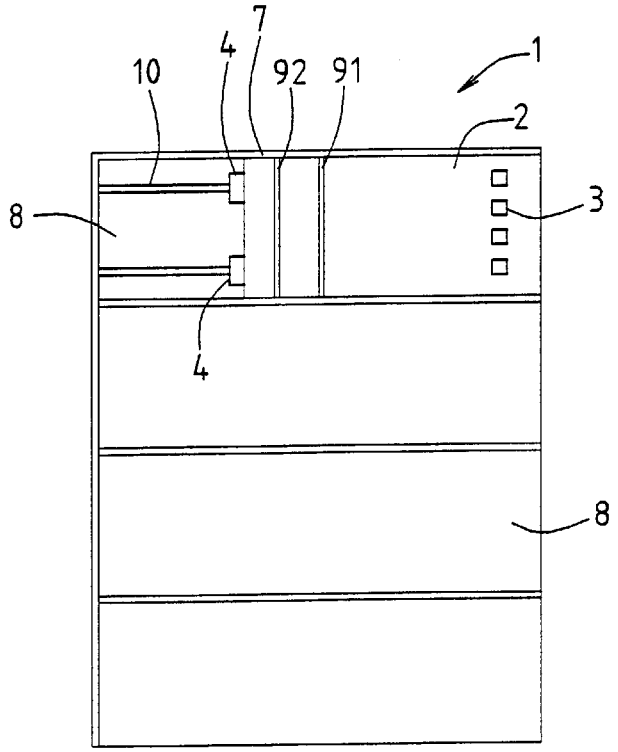
FIG. 10 diagrammatically depicts a plan view of another embodiment of the excavating device according to the invention.

The embodiment of the excavating device 1 illustrated in FIG. 10 comprises a support structure 7 which comprises compartments 8 which substantially completely surround the jet excavating units 2. In this preferred embodiment of the excavating device 1, the sensors 4 are arranged inside the support structure 7. This configuration of the support structure 7 allows various embodiments of the jet excavating units 2, two of which are illustrated in FIGS. 2*a* and 2*b*.

Figure 10A:
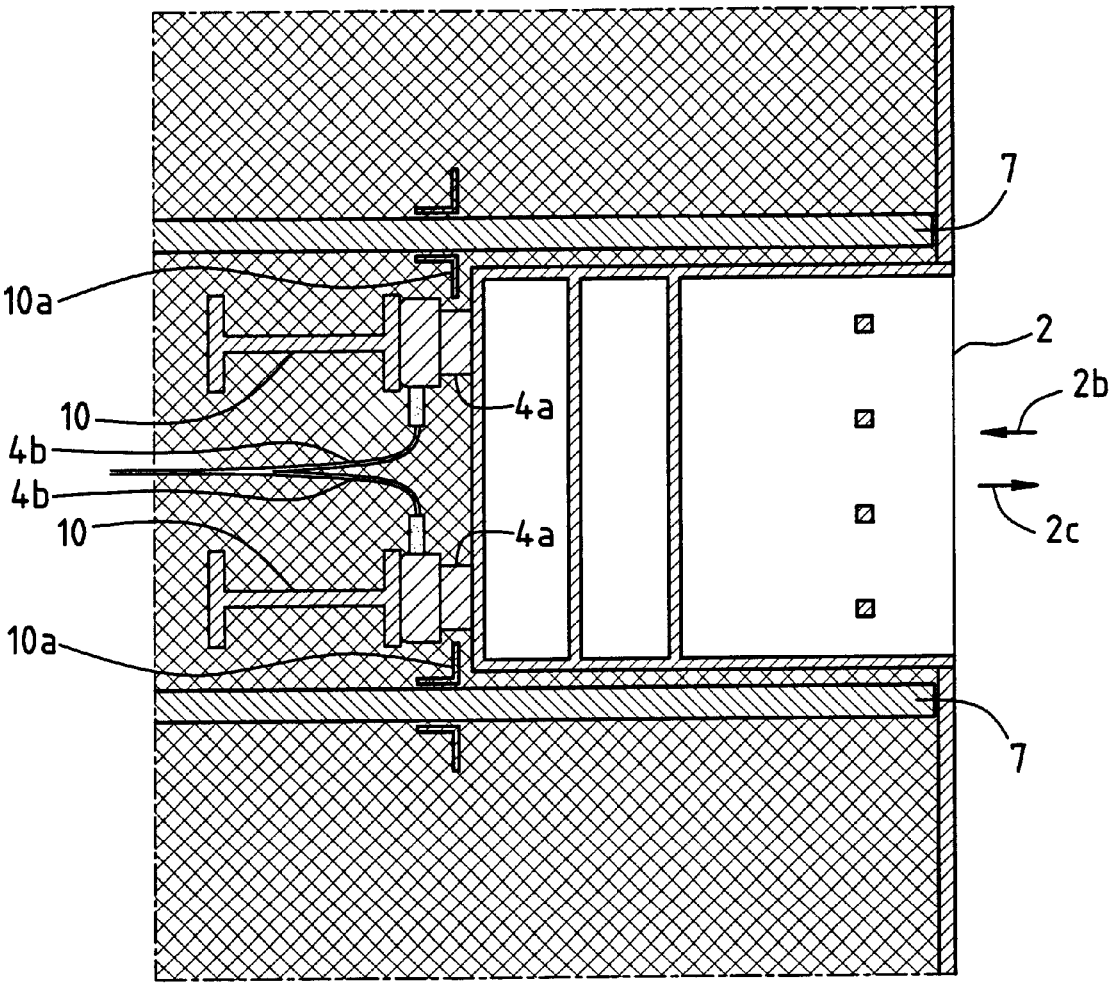
FIG. 10*a* shows a partial cross section, in more detail, of part of the excavating device shown in FIG. 10.

FIG. 10*a* shows part of the support structure 7, in which the jet excavating unit 2 can move a short distance in the directions indicated by arrows 2*b*, 2*c*. The movement of the jet excavating unit 2 in the direction of the arrow 2*b* is limited by stops 10*a*. The jet excavating unit 2 is supported against the connecting bars 10 via sensors in the form of piston-cylinder units 4*a*. The pressures of fluids situated in the piston-cylinder units 4*a* are measured via lines 4*b*, which pressures represent a measure in particular of the force exerted on the jet excavating unit 2 in the direction of arrow 2*b*, provided that the jet excavating unit 2 is not bearing against one of the stops 10*a*.

Figure 10B:
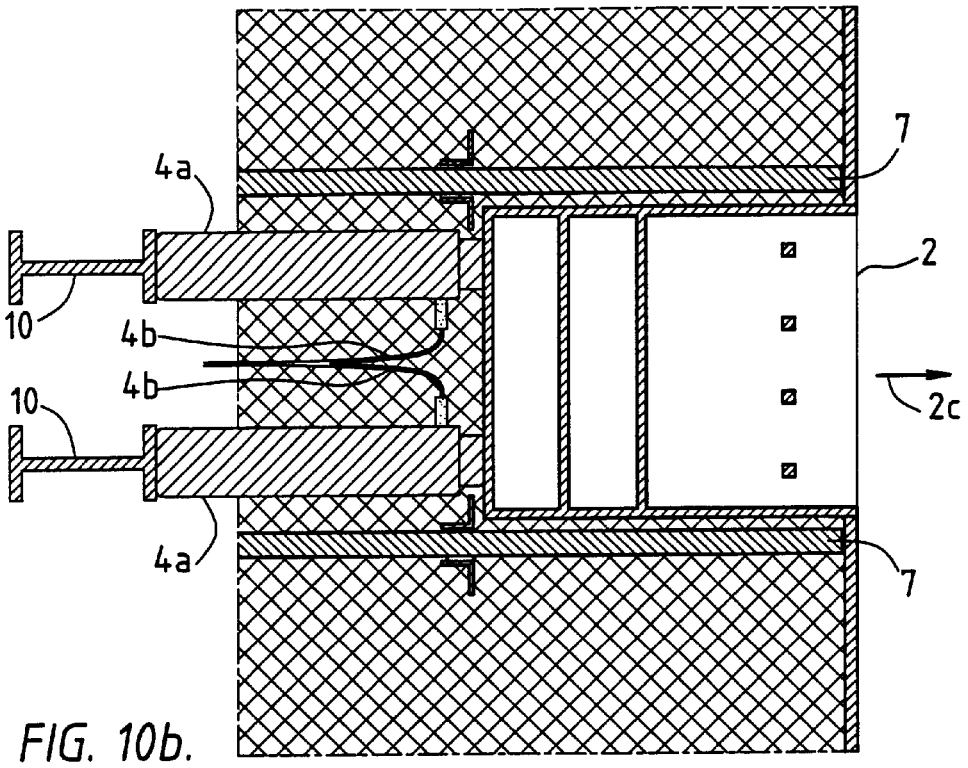
FIGS. 10*b* and 10*c* show a variant of the embodiment shown in FIG. 10*a*, in two different operating states.
Figure 10C:
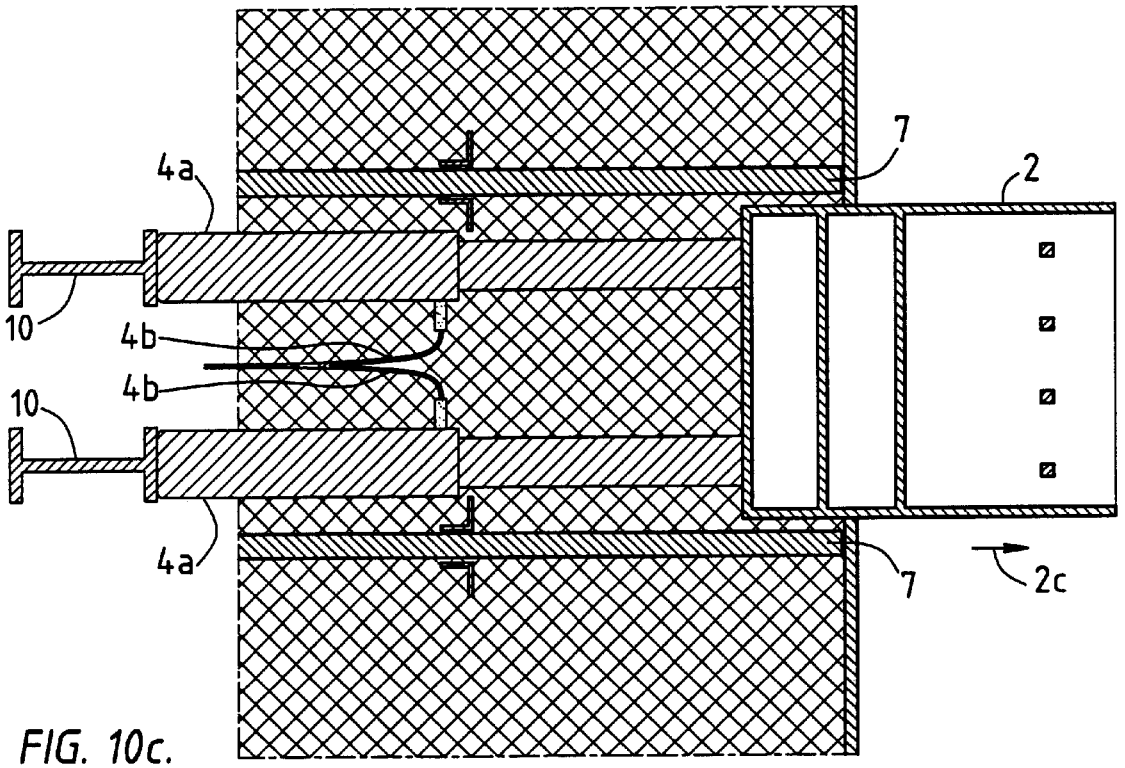

The arrangement shown in FIGS. 10*b* and 10*c* essentially differs from that shown in FIG. 10*a* only in that the stroke of the piston-cylinder units 4*a* is selected to be considerably greater. Because of this, the piston-cylinder units 4*a* are not only able to function as sensors, but also can be used to displace the jet excavating unit 2 over a considerable distance. This can be seen by comparing FIGS. 10*b* and 10*c*, the first of these figures showing the piston-cylinder units 4*a* at the beginning of their stroke, and the second of these figures showing the piston-cylinder units 4*a* at the end of their stroke. Thus, the jet excavating unit 2 can be moved forwards in the soil in the direction of arrow 2*c* independently of the support structure 7. This requires considerably less force than is necessary to move some or all of the jet excavating units of an excavating device in the direction of arrow 2*c*, optionally in combination with an advancing movement of the support structure in the same direction, so that sequential forwards movement of jet excavating units requires a lower installed power than moving all the jet excavating units forwards simultaneously. Note that only the jet device of those jet excavating units which are being moved forwards has to be actuated, so that it is also possible to reduce the installed jet power. Furthermore, jet excavating units which are blocked by an obstacle in the ground do not impede the advancement of adjoining jet excavating units over the stroke of the piston-cylinder units 4*a*, so that the obstacle can be at least partially excavated around before it is removed. It will be clear that this facilitates removal compared to the situation in which the jet excavating units are not moveable with respect to the support structure.

Figure 11A:
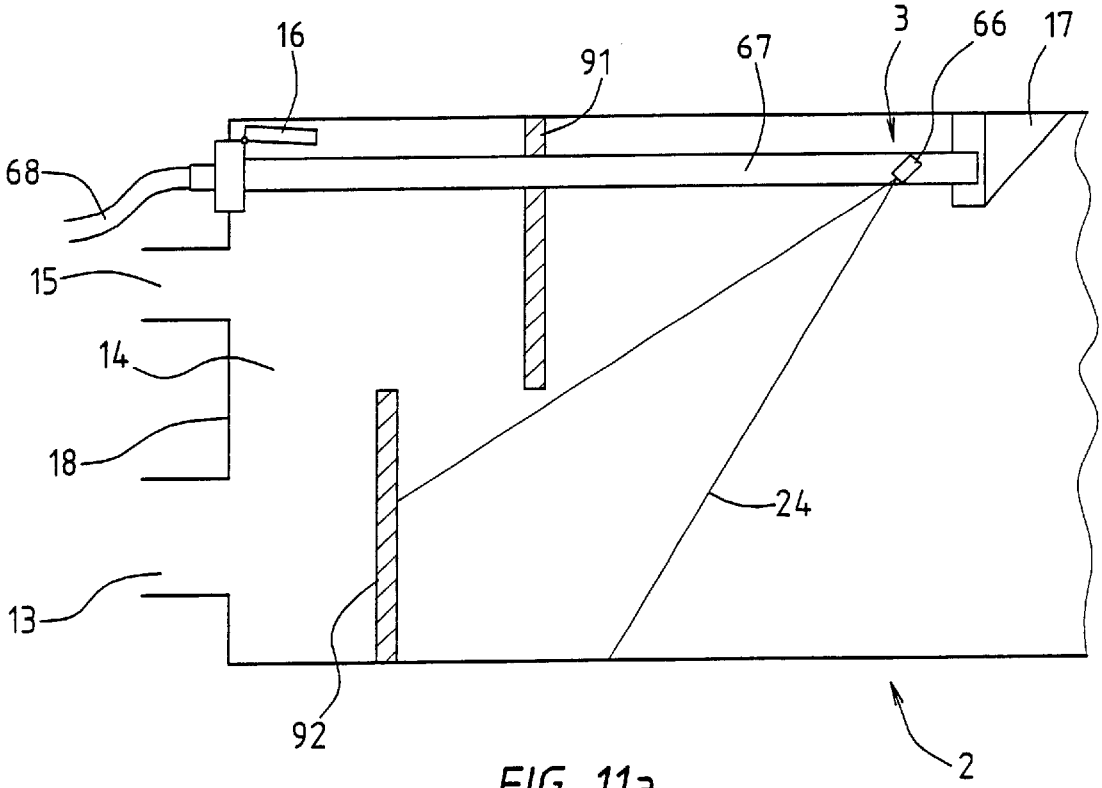
FIGS. 11*a* and 11*b* show a side view, partially in longitudinal section, and a front view, respectively, of a jet device in a jet excavating unit.
Figure 11B:
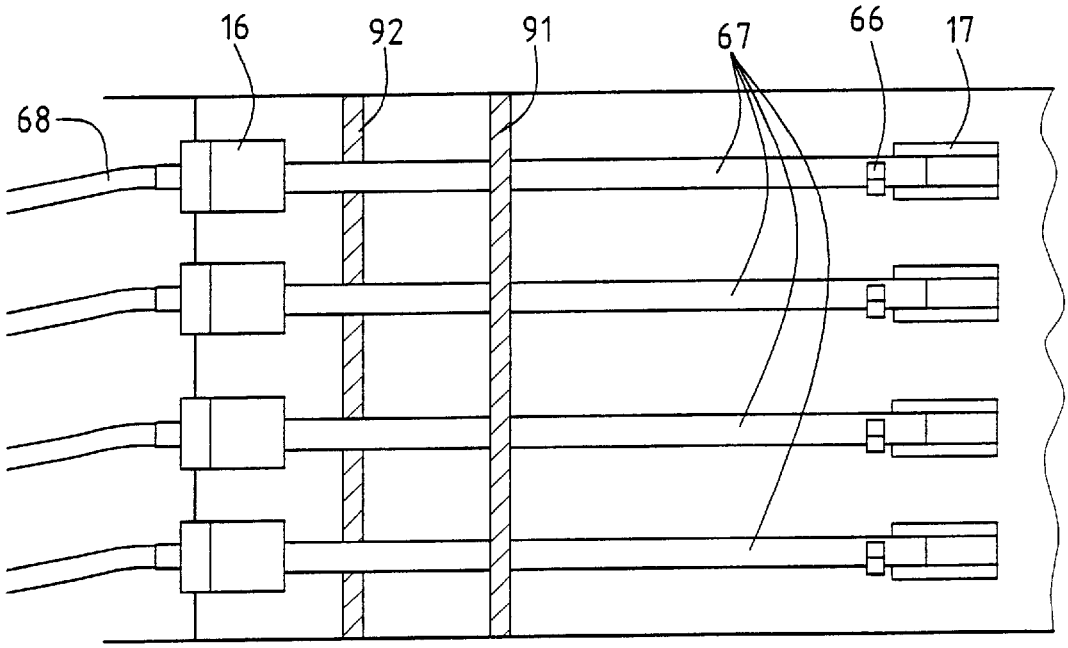

FIGS. 11*a* and 11*b* show views of another embodiment of the jet device 3 of a jet excavating unit 2. The jet device 3 comprises a spray head 66 and a tube piece 67 which is connected, via a valve or closure means 16, to a feed line 68. At the location of the spray head 66, the tube piece 67 is supported by attachment bracket or means 17 which are arranged on a top wall of the jet excavating unit 2. This embodiment of the jet device 3 allows simple installation and removal of the jet device 3, for example for maintenance purposes. The closure means 16 ensures that when the jet device 3 is removed, the pressure difference which prevails between the area in front of and behind a back wall 18 of the jet excavating unit 2 does not have to be evened out.

Figure 12:
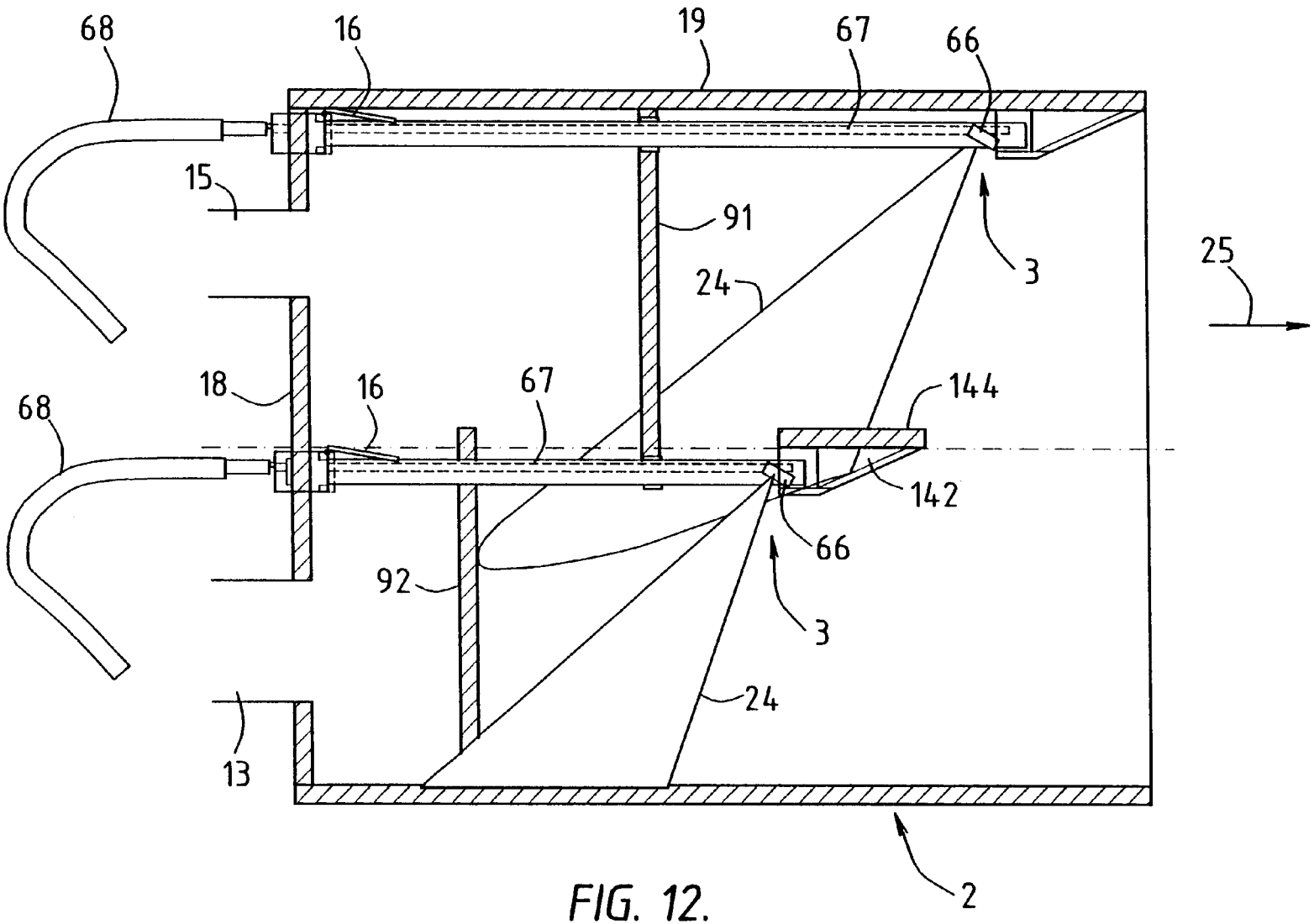
FIG. 12 shows a side view, partially in longitudinal section, of another jet excavating unit according to the invention.
Figure 12A:
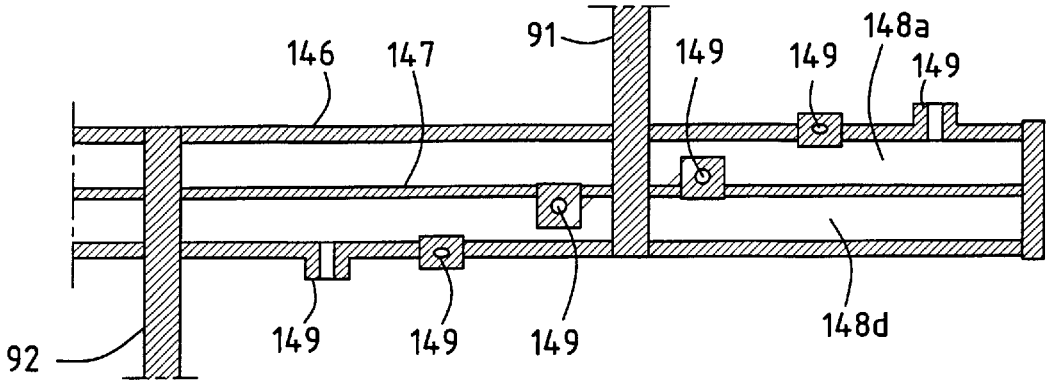
FIG. 12*a* shows a partially cut-away side view of a jet liquid tube.

FIG. 12 shows another embodiment of the jet devices 3 in the jet excavating unit 2. In this case, two series of jet devices 3 of the type described in FIGS. 11*a* and 11*b* are positioned above one another. The jet devices 3 which are arranged substantially over half the height of the jet excavating unit are supported in attachment bracket or means 142 which are held by a transverse bar 144. This embodiment is beneficial in particular in the case of jet excavating units 2 which run extensively in the upward direction. In jet excavating units 2 of this type, the force of the jet liquid jets sprayed out of spray heads 66 arranged on a top wall 19 of the jet excavating unit 2 by the jet devices 3 is insufficient to break up the soil on the underside of the jet excavating unit 2, so that an additional jet device 3 is arranged closer to the underside of the jet excavating unit 2. Naturally, other embodiments of arrangement of jet devices 3 are possible, such as for example more than two jet devices 3 positioned above one another, jet devices 3 positioned next to one another in the excavation direction 25, jet devices 3 with jets 24 arranged at an angle to the excavation direction 25, jet devices 3 arranged on side walls of the jet excavating unit 2, jet devices 3 arranged on the top wall and the bottom wall, jet devices 3 with jets 24 which are oriented transversely to the excavation direction 25, jet devices 3 with jets 24 which are oriented parallel to the excavation direction, jet devices 3 arranged on a plate 91 or 92, jet devices 3 arranged on the back wall 18 of the jet excavating unit 2, or a combination of these options.

Figure 12B:
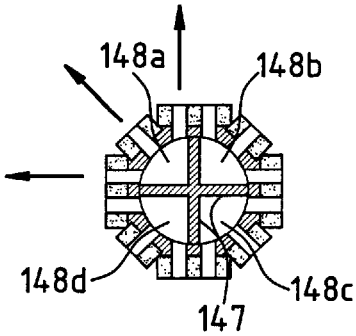
FIG. 12*b* shows a diagrammatic cross section through the jet liquid tube shown in FIG. 12*a*.
Figure 12C:
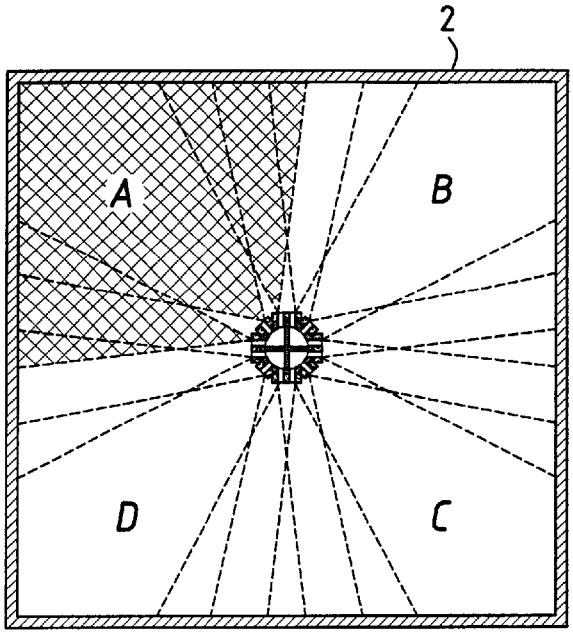
FIG. 12*c* shows a front view of the way in which the jet liquid tube shown in FIG. 12*a* operates in a jet excavating unit.
Figure 12D:
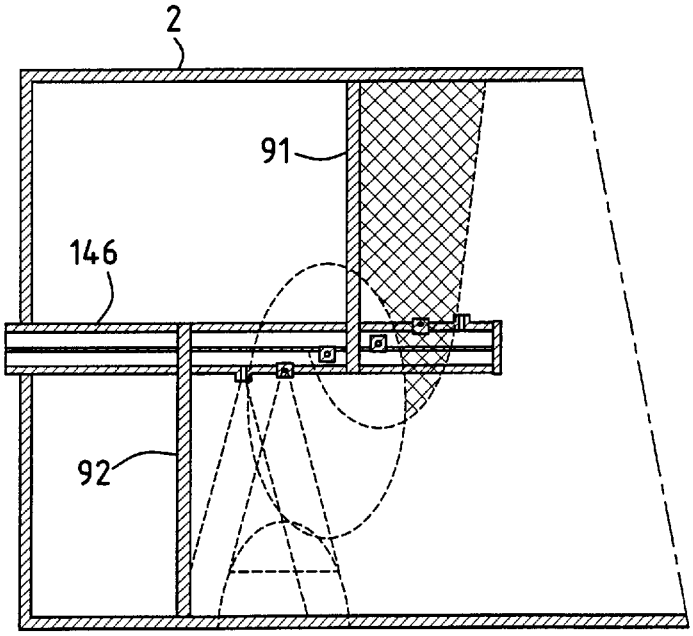
FIG. 12*d* shows a side view of the way in which the jet liquid tube shown in FIG. 12*a* operates in a jet excavating unit.

FIGS. 12*a*–12*d* show a jet liquid tube 146 which is divided into four passages 148*a*–148*d* by internally arranged partitions 147. Outlet openings 149 are arranged on the circumference of the tube 146, at a distance from one another in the longitudinal direction and at different angles in the circumferential direction. If it is ensured that each of the passages 148*a*–148*d* can be separately provided with jet liquid by a suitable valve control mechanism, jet liquid only flows out of the outlet openings 149 which correspond to the passage in question. FIGS. 12*b*, 12*c* and 12*d* illustrate in particular the flow of jet liquid out of the outlet openings 149 corresponding to the passage 148*a*, into a sector A of a jet excavating unit 2. Other sectors B, C and D may be provided with jet liquid continuously or intermittently/in a pulsed supply, optionally simultaneously. In a similar way to that in which different sectors of a jet excavating unit may be provided intermittently or in a pulsed manner, optionally simultaneously, with jet liquid, it is also possible to actuate different jet excavating units, i.e. for these units to be actuated continuously or intermittently, successively or (possibly partially) simultaneously with other jet excavating units.

Figure 13A:
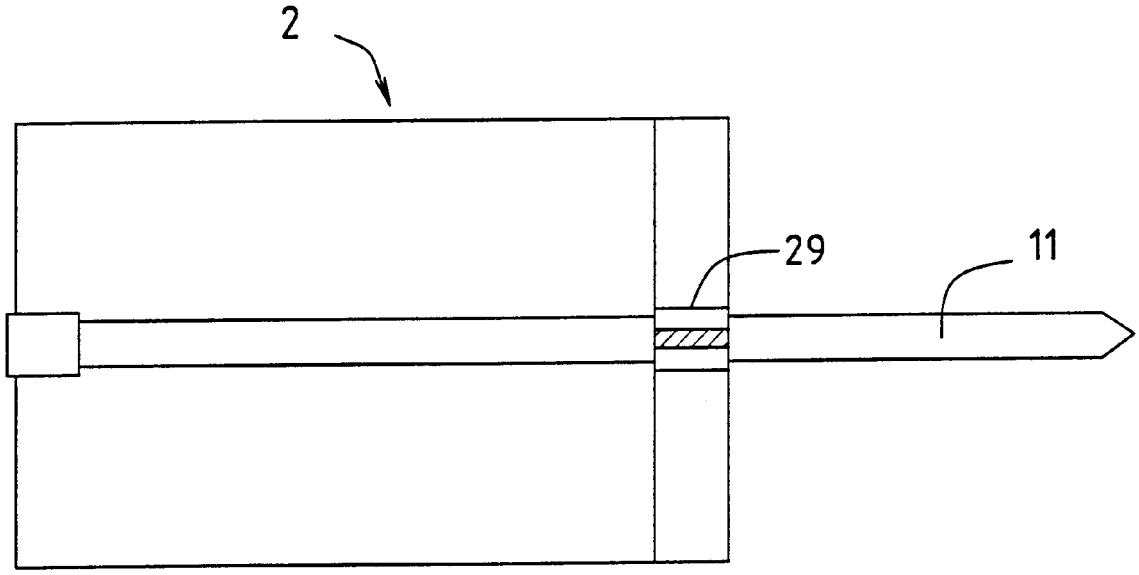
FIGS. 13*a* and 13*b* show a side view, partially in longitudinal section, and a front view, respectively, of a jet excavating unit in which a probe is arranged.
Figure 13B:
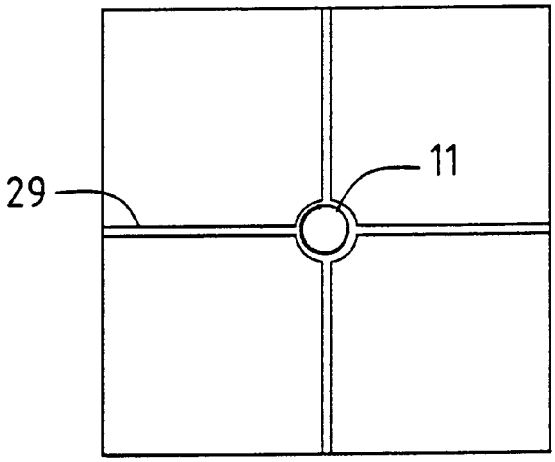
Figure 14:
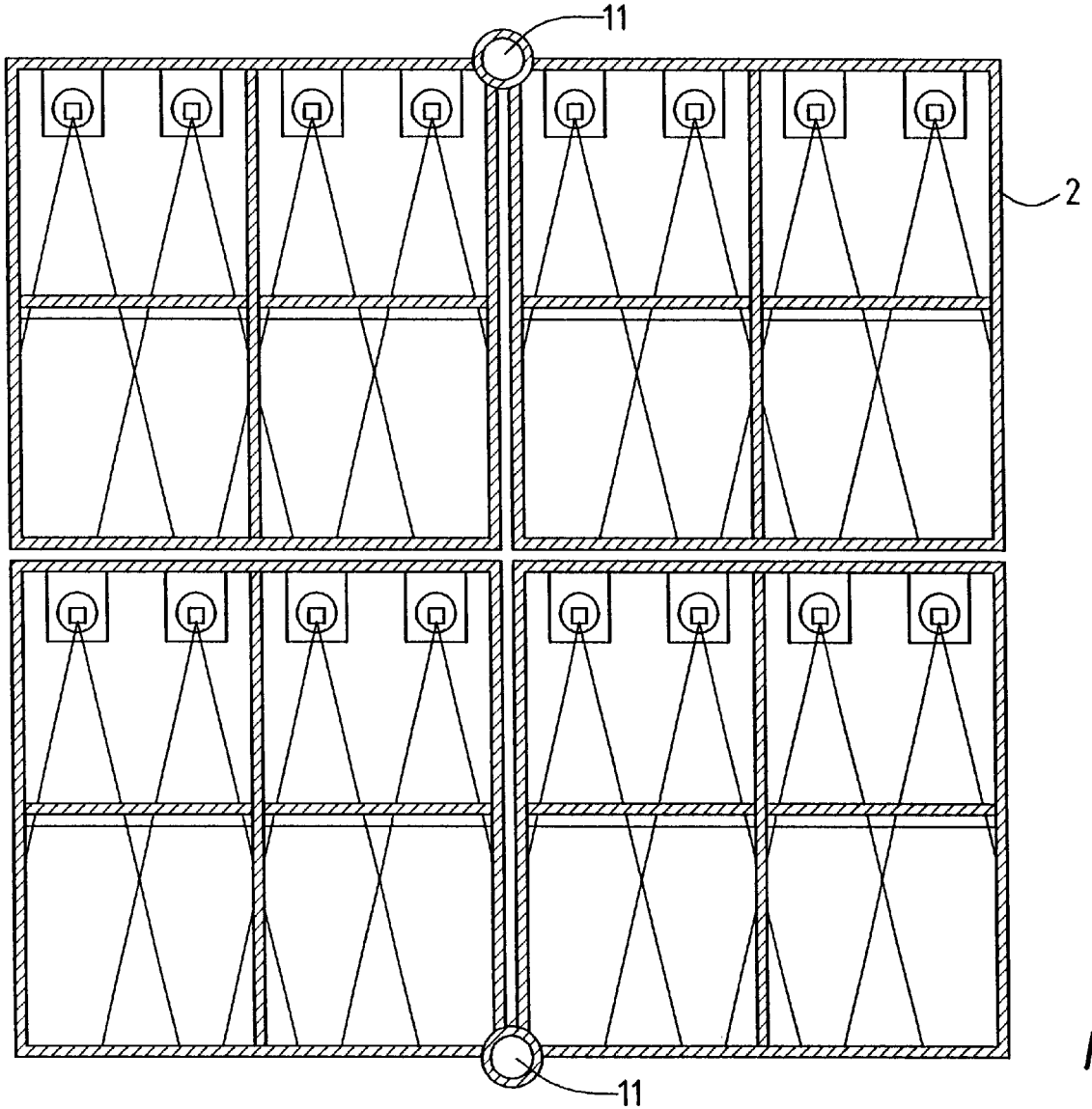
FIG. 14 shows a front view of an assembly of a plurality of jet excavating units, between which a plurality of probes are arranged.

FIGS. 13*a* and 13*b* show the jet excavating unit 2 of an excavating device 1. A probe 11 determines the nature of the soil in front of the excavating device 1. In the excavating device 1 according to the invention, the probe 11 can be used during excavation, since there are no bucket-wheel excavating devices or the like which could damage the probe 11. The probe 11 is supported by a frame 29, as indicated in FIG. 13*b*. In this way, the probe 11 can be arranged in the center of the cross-sectional area of the jet excavating unit 2, but may also, for example, be arranged between jet excavating units 2, as shown in FIG. 14. In addition, it is possible for the probe to be arranged at any other desired location in the cross section of a jet excavating unit 2, for example by adapting the frame 29.

Figure 15C:
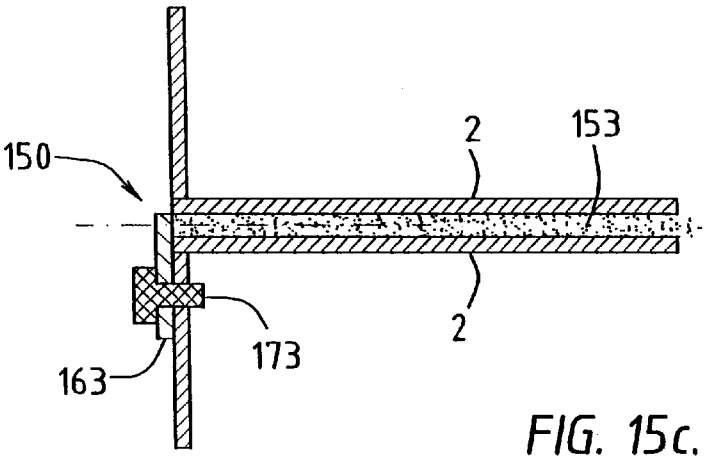
FIGS. 15*a*–15*d* show cross-sectional views of sealing means which are arranged between mutually adjacent jet excavating units.
Figure 15D:
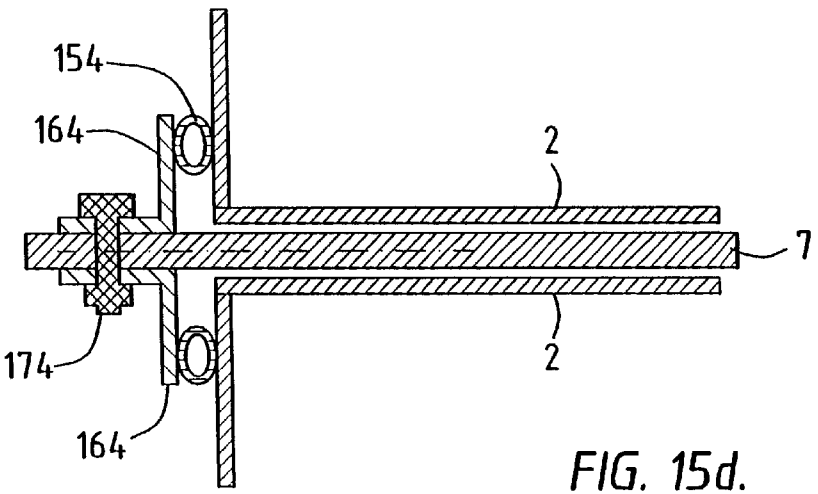
Figure 15A:
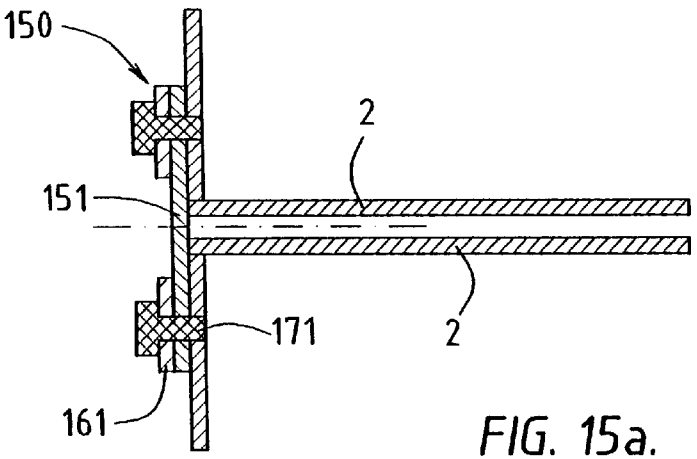
Figure 15B:
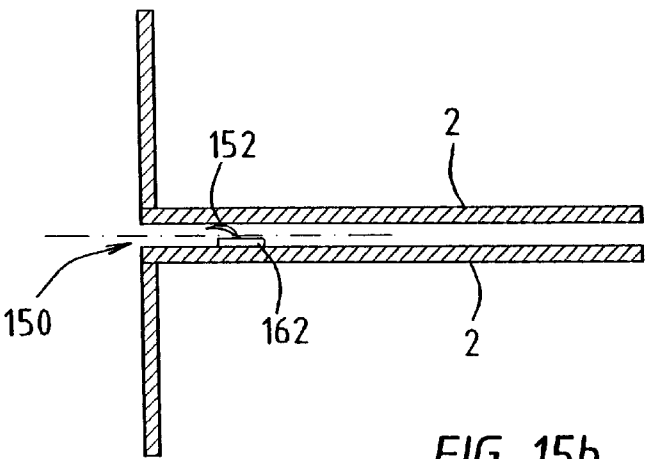

FIGS. 15*a*–15*d* show various embodiments of sealing devices or means 150. A high pressure of groundwater and soil particles prevails in front of the jet excavating units 2. The atmospheric pressure of the inside of the channel formed in the ground prevails behind the jet excavating units 2. The jet excavating units 2 can in principle move independently of one another in the support structure 7, so that it is necessary to ensure a good seal for any space between the jet excavating units 2. Furthermore, the jet excavating units 2 have to be removable, so that obstacles can be removed and access can be gained to the excavation front ahead of the excavating device 1, and consequently the sealing means 150 also has to be made removable. This sealing means 150 can be produced in numerous different ways. FIG. 15*a* shows a sealing device or means which comprises a deformable part 151, a rigid part 161 and a securing device or means 171. The deformable part 151 is secured over the space between the jet excavating units 2 by securing means 171, the rigid part 161 being enclosed above the deformable part and below the securing means 171. The securing means 171 is, for example, a screw or a bolt which can be removed from the back wall of the jet excavating unit, so that the sealing means 150 can easily be removed. FIG. 15*b* shows a sealing means 150 which comprises a rigid part 162 which is arranged in the space between the side walls of two adjacent jet excavating units 2, and a deformable part 152 which is arranged on the rigid part 162 and connects the space between the rigid part 162 and the opposite side wall of an adjacent jet excavating unit 2. In FIG. 15*c*, the sealing means 150 comprises a rigid part 163, a securing part 173 and a foam-like part 153. The rigid part 163 closes off the space between two adjacent jet excavating units 2 at the location of the back wall of the jet excavating units 2 and is secured to one of the jet excavating units 2 by the securing means 173. In FIG. 15*d*, the sealing means 150 comprises deformable parts 154, angle brackets 164 and a securing device or means 174. Behind the back wall of the jet excavating units 2, angle brackets 164 are positioned on the wall of a compartment of the support structure 7 along which two adjacent jet excavating units 2 are arranged, both on one side and on the other side, a limb of the first angle bracket 164 being connected to the corresponding limb of the second angle bracket 164 by the securing means 174, so that the angle brackets 164 are rigidly connected to the wall of the support structure 7. The other limb of the angle bracket 164 is connected to the back wall of the jet excavating unit 2 via one of the deformable parts 154, so that the space between the adjacent jet excavating units 2 is sealed.

Figure 16:
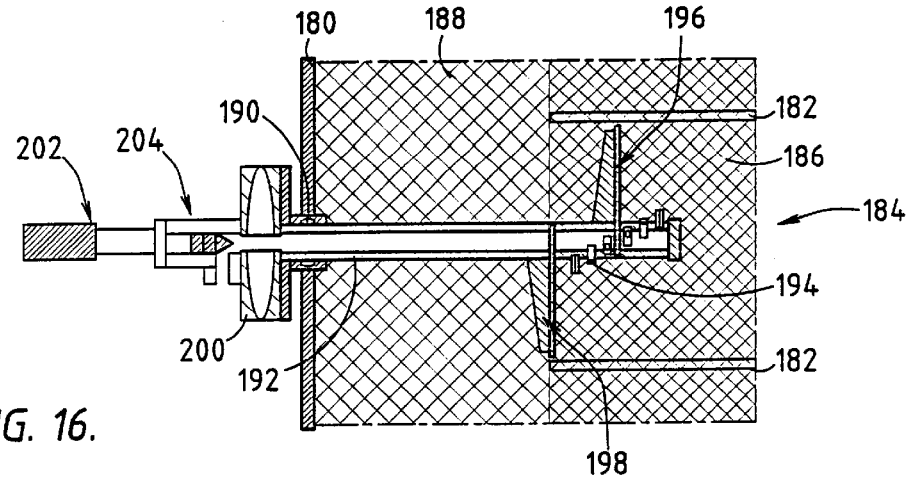
FIG. 16 shows, in a partial longitudinal section through part of an excavating device according to the invention, a jet device which is combined with a force pick-up device.

FIG. 16 shows part of a back wall 180 of an excavating device, of which walls 182 between a jet excavating unit 184 and adjoining jet excavating units also form part. The jet excavating unit 184 has an excavation chamber 186 and a mixing chamber 188 which is common to various jet excavating units 184. In the back wall 180 there is a sealing passage 190 through which a jet liquid tube 192 can slide. The jet liquid tube 192 is provided with outlet openings 194, as has already been discussed in more detail above with reference to FIGS. 12*a*–12*d*. A front plate 196 and a back plate 198 are attached to the jet liquid tube 192. On that side of the back wall 180 which is facing away from the jet excavating unit 184, the jet liquid tube 192 is supported on a force sensor 200 which is known per se, is not shown in detail and by means of which forces which are exerted on the plates 196 and 198 and are transmitted to the jet liquid tube 192 can be measured. The jet liquid tube 192 is also connected to a piston-cylinder unit 202, by means of which the jet liquid tube 192 can be displaced to the left from the position shown in FIG. 16 until the back plate 198 comes into contact with the passage 190, and vice versa. As an alternative to the force sensor 200, the piston-cylinder unit 202 can be used to measure the forces exerted on the plates 196 and 198 and transmitted to the jet liquid tube 192. The jet liquid tube 192 is provided with a diagrammatically illustrated controllable valve 204, the passage through which can be adjusted on the basis of the force measured by the force sensor 200 or the piston-cylinder unit 202. The force sensor 200 has a central jet liquid passage for the passage of jet liquid from the valve 204 to the jet liquid tube 192.

Figure 17:
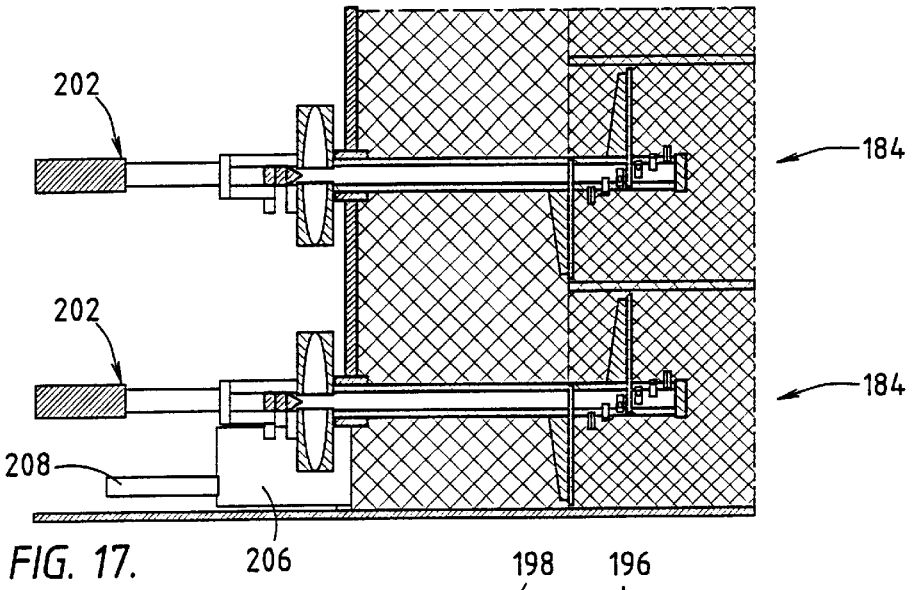
FIG. 17 shows a similar longitudinal section to that shown in FIG. 16, illustrating a closer view of a mixing chamber.

FIG. 17 shows two jet excavating units 184 with a common mixing chamber 188. On the underside of the mixing chamber there is a pump 206 for discharging the mixture of jet liquid and soil which is situated in the mixing chamber 188 to a discharge line 208.

Figure 18:
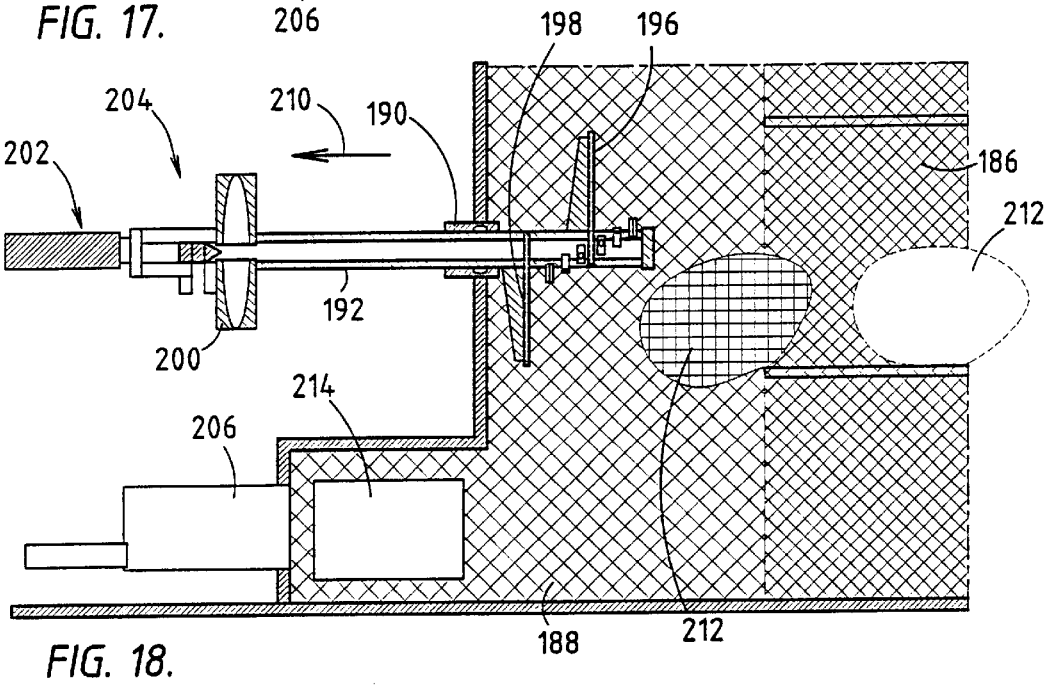
FIG. 18 shows the use of the jet device shown in FIGS. 16 and 17 for removing an obstacle.

FIG. 18 illustrates the way in which the jet liquid tube 192 and the plates 196, 198 connected thereto can be displaced in the direction of arrow 210 with the aid of the piston-cylinder unit 202 until the back plate 198 comes into contact with the passage 190. The valve 204 is closed. This option is advantageous in particular in order to allow an obstacle 212 situated in the excavation chamber 186 to enter the mixing chamber 188. If the dimensions of the obstacle are larger than the maximum dimensions of pieces which can be pumped through the pump 206, the obstacle 212 can be crushed in a crusher 214 and then discharged by the pump 206. Alternatively, the mixing chamber 188 could also be opened in the vicinity of its underside in order for the obstacle 212 to be removed.

In the position of the plates 196, 198 which is shown in FIG. 18, the normal supporting function of the plates with respect to the excavation front is no longer present. If the expectation is that the excavation front in the excavation chamber 186 will not hold in this situation, the mixing chamber is temporarily filled with a support liquid, such as bentonite, via a suitable feed opening, and is pressurized to such an extent that sufficient support is offered to the excavation front. As an alternative, bentonite can be sprayed onto the exposed excavation front via the tube 192, and the mixing chamber 188 can be filled with pressurized air (for example if human intervention in the mixing chamber 188 should be desirable).

Figure 19:
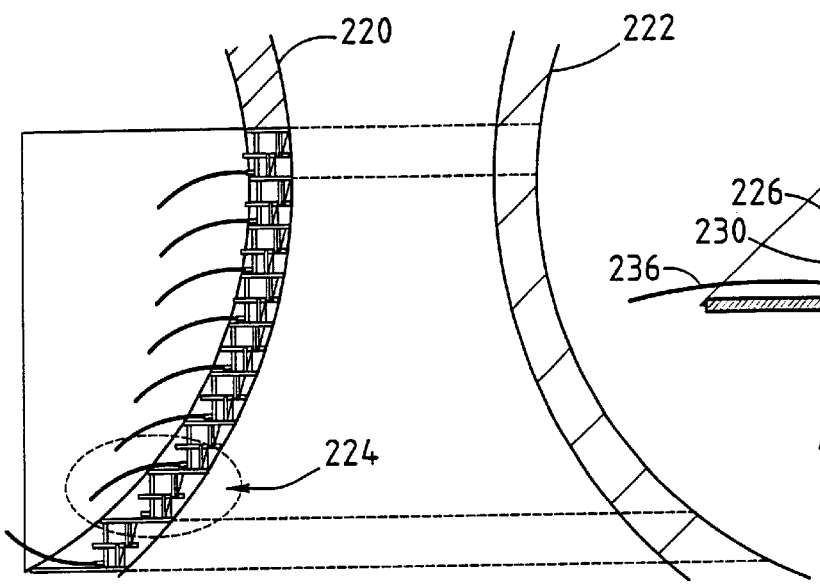
FIG. 19 shows a partial longitudinal section through a specific arrangement of an assembly of jet excavating units according to the invention.
Figure 19A:
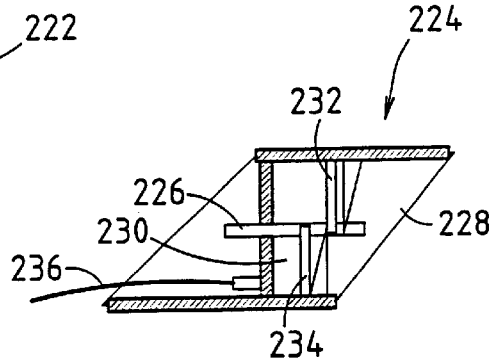
FIG. 19*a* shows a detail from FIG. 19 which is indicated by a dashed line.

FIG. 19 makes it clear that that side of the jet excavating units which is to face towards the soil may be shaped in such a manner that an inclined or curved surface is formed on the front side of the excavating device, instead of a surface which is oriented transversely to the excavation direction as shown in FIG. 9. FIG. 19 shows a cross section through two channel walls 220, 222, with a number of jet excavating units 224 positioned in the channel wall 220. The jet excavating units 224 are accommodated in a support structure and, as illustrated more clearly in FIG. 19*a,* each comprise a jet liquid tube 226, an excavation chamber 228, a mixing chamber 230, a front plate 232, a back plate 234, and a pump 236 for discharging a mixture of jet liquid and soil.

The option illustrated in FIG. 19 is advantageous, for example, when making transverse connections between previously dug tunnels. Components of the excavating device for forming the transverse connection may already be incorporated in the wall 220 of a tunnelling tube as a wall element when forming a tunnel, such as (components of) the support structure, front plates and back plates. To commence formation of the transverse connection, the other components are arranged so as to make the excavating device operational.

Figure 20:
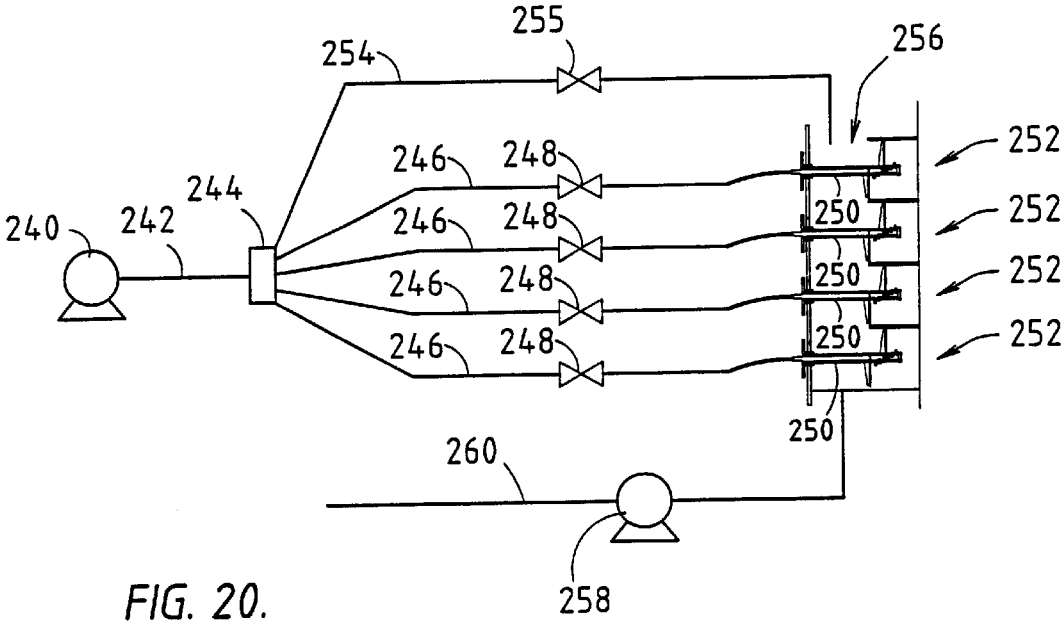
FIG. 20 diagrammatically depicts the way in which jet liquid is supplied to the excavating device shown in FIGS. 16–18.

FIG. 20 shows a pump 240 with a delivery line 242 which is connected to a manifold 244. From the manifold 244, a plurality of, in this case four, lines 246, each provided with a controllable valve 248, run to jet liquid tubes 250 of jet excavating units 252. A system line 254, in which a controllable valve 255 is incorporated, also runs from the manifold 244 to a common mixing chamber 256 of the jet excavating units 252. A pump 258 discharges a mixture of jet liquid and soil which collects in the mixing chamber 256 via a line 260.

The pump 240 supplies a constant flow rate which is adapted to the maximum amount of jet liquid required. This amount of liquid is distributed to the various jet excavating units 252 by the control means of the excavating device, with the aid of the valves 248, on the basis of the measured excavation force for each jet excavating unit 252. The remaining amount of jet liquid flows through the system line 254, via the valve 255, to the mixing chamber 256. In this way, the total amount of jet liquid supplied by the pump 240 to the excavating device is not influenced by the constantly changing jet liquid requirements of the individual jet excavating units 252, and the flow of jet liquid/soil mixture which the pump 258 has to discharge is constant. If the nature of the soil is such that the maximum jet capacity is required, all the flow supplied by the pump 240 passes to one or more jet excavating units 252. On the other hand, if no jet capacity is required, the entire flow supplied by the pump 240 passes via the valve 255 to the mixing chamber 256.

The valve 255 regulates the pressure, referred to here as the system pressure, upstream of the valves 248. This system pressure must always be at least a fraction higher than the maximum pressure required at a specific moment for the one or more jet excavating units. As a result of the system pressure being varied, the delivery pressure of the pump 240 is no higher, or only slightly higher, than necessary, and the pressure drop across the valves 248 is minimized. As a result, the energy loss in the pump system also remains limited.

The system pressure may also be divided into predetermined ranges, for example from 0–10 bar, from 10–30 bar, and from 30–50 bar. For example, if the maximum system pressure required at a specific moment is 17 bar, the valve 255 provides a system pressure of 30 bar, since 17 bar lies in the range from 10–30 bar.

The excavating process can be controlled not only by measuring the forces which are exerted on the at least one jet excavating unit by the ground. By way of alternative, it is possible to monitor a so-called mass balance or soil balance for one or more jet excavating units. The amount of soil collected by the one or more jet excavating units is calculated from the displacement of the jet excavating device in the excavation direction per unit time. The amount of soil which has been excavated by the one or more jet excavating units is determined by measuring the flow rate of the mixture which is discharged from the jet excavating unit or jet excavating units and measuring the density of this mixture. In this case, the control means for controlling the excavation by the excavating device act on the basis of the determined soil balance, for example in order to set a flow rate of the jet liquid used in at least one of the jet devices. All of the other functions which were obtained above on the basis of a force measurement at one or more jet excavating units can also be obtained on the basis of monitoring the soil balance. To measure the density, use is made of nuclear radiation, for which adequate protective measures are required.

While the invention has been described and illustrated in its preferred embodiments, it should be understood that departures may be made therefrom within the scope of the invention, which is not limited to the details disclosed herein. For example, it is possible for one or more sensors 4 to be used not only for an assembly of jet excavating units 2, but also for a single jet excavating unit, in which case, although maintaining the soil balance is adequate to obtain a successfully controllable excavation process, it is less effective, simple and inexpensive than the option of using sensors to measure forces which the soil to be excavated exerts on the excavating device in order to control the excavation.

What is claimed is:

1. An excavating device for forming a channel of predetermined cross section in the ground, in an excavation direction, comprising:

an assembly of jet excavating units, which together define the cross section of the channel and are each provided with at least one jet device which is adapted to be operated with jet liquid;

at least one sensor which is connected to at least one of the jet excavating units, and is configured to measure a force which is exerted on the at least one jet excavating unit by the ground substantially parallel to the excavation direction; and a controller configured to control the excavation by the excavating device on the basis of the force measured by the at least one sensor.

2. The excavating device of claim 1, wherein the controller is adapted to set a flow rate of the jet liquid used in at least one of the jet devices.

3. The excavating device of claim 2, wherein the controller is adapted to set the flow rate of the jet liquid of the at least one jet device of the jet excavating unit which is connected to the at least one sensor.

4. The excavating device of claim 2, wherein the controller is adapted to increase or reduce the flow rate of the jet liquid of the at least one jet device in the event of an increase or decrease in the force measured by the at least one sensor.

5. The excavating device of claim 2, wherein the setting of the flow rate of the jet liquid of the at least one jet device is configured to be varied between a predetermined minimum level and a predetermined maximum level.

6. The excavating device of claim 1, wherein the controller is adapted to vary the flow rate of the jet liquid of the at least one jet device of at least one jet excavating unit between a predetermined minimum and a predetermined maximum level on the basis of the force measured by the at least one sensor connected to the at least one jet excavating unit.

7. The excavating device of claim 1, wherein the controller is adapted to feed jet liquid to the at least one jet device of at least one of the jet excavating units where the force exceeds a defined level, and to limit the feed of jet liquid to a minimum value when the force has fallen below the said level.

8. The excavating device of claim 1, wherein the jet devices are each fed, via a line in which a controllable valve is incorporated, from a jet pump which supplies a constant flow rate of jet liquid, that fraction of the jet liquid flow which is not taken up by the jet devices being supplied, via at least one system line in which a controllable valve is incorporated, to a space of the jet excavating units.

9. The excavating device of claim 8, wherein the controller is adapted to set the controllable valve in the at least one system line in such a manner that a delivery pressure set for the jet pump is marginally higher than the maximum pressure required for the jet devices.

10. The excavating device of claim 1, further comprising a drive device configured to displace the excavating device substantially in the excavation direction, wherein the controller is adapted to control the drive device.

11. The excavating device of claim 10, wherein the controller is adapted to measure the current amount of jet liquid required for the assembly of jet excavating units and to adapt the velocity of the drive device to the available flow of jet liquid for the assembly of jet excavating units.

12. The excavating device of claim 1, comprising a support structure which supports the jet excavating units.

13. The excavating device of claim 12, wherein part of the support structure is configured to be removed for the purpose of removing at least one of the jet excavating units.

14. The excavating device of claim 12, wherein the support structure is provided with compartments which substantially completely surround the jet excavating units.

15. The excavating device of claim 12, wherein at least one of the jet excavating units is configured to be displaced with respect to the support structure, substantially parallel to the excavation direction, with the aid of a displacement device.

16. The excavating device of claim 15, wherein the displacement device comprises at least one jack.

17. The excavating device of claim 1, wherein the at least one jet device of at least one jet excavating unit is adapted to expel a jet of jet liquid in a fixed direction.

18. The excavating device of claim 1, wherein the at least one jet device of the at least one jet excavating unit is adapted to be operated intermittently.

19. The excavating device of claim 17, wherein the jet liquid jet which is expelled in a fixed direction from the at least one jet device of the at least one jet excavating unit is oriented at an angle to the excavation direction.

20. The excavating device of claim 19, wherein the jet liquid jet which is expelled in a fixed direction from the at least one jet device of the at least one jet excavating unit is inclined backwards, as viewed in the excavation direction.

21. The excavating device of claim 1, wherein the at least one jet device comprises at least one tube which extends substantially in the excavation direction and is provided on a circumference thereof with at least one outlet opening.

22. The excavating device of claim 21, wherein the tube is arranged centrally in the jet excavating unit and comprises a number of outlet openings.

23. The excavating device of claim 22, wherein the outlet openings are positioned at a distance from one another, as viewed in the longitudinal direction of the tube.

24. The excavating device of claim 22, wherein the outlet openings are positioned at different angles, as viewed in the circumferential direction of the tube.

25. The excavating device of claim 17, wherein at least one of the jet excavating units comprises a number of jet devices, the jet liquid jets from which are oriented in different, fixed directions.

26. The excavating device of claim 25, wherein the jet devices are operated intermittently.

27. The excavating device of claim 26, wherein the jet devices are operated alternately.

28. The excavating device of claim 25, wherein at least one of the jet devices is arranged on a side wall of the at least one jet excavating unit, and in that the jet liquid jet which is expelled in a fixed direction from the at least one jet device is oriented substantially transversely to the excavation direction.

29. The excavating device of claim 1, wherein at least one jet excavating unit is provided with a securing device within which the at least one jet device thereof is releasably secured.

30. The excavating device of claim 29, wherein the jet device is arranged in the jet excavating unit through a passage in a rear wall of the jet excavating unit.

31. The excavating device of claim 30, wherein the passage comprises a closure device.

32. The excavating device of claim 1, further comprising at least one probe which is configured to determine the nature of the soil at a distance in front of the jet excavating unit, as viewed in the excavation direction, during excavation.

33. The excavating device of claim 1, further comprising at least two probes configured to determine the nature of the soil between and around the at least two probes.

34. The excavating device of claim 1, wherein there is at least one removable sealing device configured to seal space between adjoining jet excavating units.

35. The excavating device of claim 12, wherein there is at least one removable sealing device configured to seal space between a jet excavating unit and the support structure.

36. The excavating device of claim 12, wherein the at least one sensor connected to the at least one jet excavating unit is positioned between the support structure and the at least one jet excavating unit.

37. The excavating device of claim 1, wherein the at least one sensor comprises a piston-cylinder unit which is adapted to be operated by a fluid, which sensor is provided with a pressure measuring device configured to record a pressure of the fluid.

38. The excavating device of claim 1, wherein the at least one jet excavating unit comprises at least one plate which is arranged substantially transversely to the excavation direction, and in that the at least one sensor connected to the at least one jet excavating unit is adapted to measure substantially the force acting on the plate in the excavation direction.

39. The excavating device of claim 38, wherein the at least one sensor is connected to the at least one plate via the jet device.

40. The excavating device of claim 1, wherein an excavation chamber is formed in a jet excavating unit by a space in which the at least one jet device is arranged, the excavation chamber being adjoined, on the rear side, as viewed counter to the excavation direction, by, in succession, a front plate, which extends from the top side of the excavation chamber to a distance from the underside of the excavation chamber, and a back plate, which extends at a distance from the front plate, from the underside of the excavation chamber to a distance from the top side of the excavation chamber.

41. The excavating device of claim 40, wherein a mixing chamber is formed behind the back plate, by a space with an outlet opening for discharging a mixture of soil and jet liquid.

42. The excavating device of claim 41, wherein the mixing chamber comprises a space which is common to a number of jet excavating units.

43. The excavating device of claim 41, wherein the outlet opening is situated in the vicinity of an underside of the mixing chamber.

44. The excavating device of claim 41, wherein a crusher is arranged in the mixing chamber, upstream of the outlet opening.

45. The excavating device of claim 41, wherein a non-return valve is arranged between the excavation chamber and the mixing chamber, in order to allow the mixture of soil and jet liquid to pass from the excavation chamber to the mixing chamber but blocking the mixture from passing in the opposite direction.

46. The excavating device of claim 40, wherein the front plate or the back plate is connected to a grate which extends from the underside or the top side of the excavation chamber to the front plate or the back plate, respectively, in such a manner that material which is retained by the grate returns, under the force of gravity, into an area of the jet excavating unit which is directly reached by the liquid jet from the at least one jet device.

* * * * *

UNITED STATES PATENT AND TRADEMARK OFFICE

CERTIFICATE OF CORRECTION

PATENT NO. : 6,385,868 B2
DATED : May 14, 2002
INVENTOR(S) : Koene et al.

It is certified that error appears in the above-identified patent and that said Letters Patent is hereby corrected as shown below:

Title page,
Item [63], the Related U.S. Application Data, should read:
-- [63] Continuation of application No. PCT/NL00/00459, filed on Jun. 30, 2000. --
Item [75], should read:
-- Inventors: Rogier Cristian Koene, Delft; Rokus Van Den Bout, The Hague; Frits-Jan Koppert, Nieuwerkerkaan de Ijssel; Cornelis Van Zandwijk, Waddinxveen, all of (NL) --

Signed and Sealed this

Eighteenth Day of February, 2003

JAMES E. ROGAN
*Director of the United States Patent and Trademark Office*